US011292268B2

(12) United States Patent
Kawafuji

(10) Patent No.: US 11,292,268 B2
(45) Date of Patent: Apr. 5, 2022

(54) PRINTING APPARATUS, REGISTRATION ADJUSTMENT METHOD, AND STORAGE MEDIUM

(71) Applicant: CANON KABUSHIKI KAISHA, Tokyo (JP)

(72) Inventor: Hiroshi Kawafuji, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 91 days.

(21) Appl. No.: 16/808,827

(22) Filed: Mar. 4, 2020

(65) Prior Publication Data

US 2020/0290367 A1 Sep. 17, 2020

(30) Foreign Application Priority Data

Mar. 12, 2019 (JP) ..... JP2019-044611

(51) Int. Cl.

| | |
|---|---|
| ***B41J 2/21*** | (2006.01) |
| ***B41J 2/045*** | (2006.01) |
| ***B41J 29/393*** | (2006.01) |
| ***B41J 19/14*** | (2006.01) |

(52) U.S. Cl.

CPC ..... *B41J 2/2135* (2013.01); *B41J 2/04505* (2013.01); *B41J 2/2139* (2013.01); *B41J 19/145* (2013.01); *B41J 29/393* (2013.01)

(58) Field of Classification Search

CPC ..... B41J 19/145

See application file for complete search history.

(56) References Cited

U.S. PATENT DOCUMENTS

| | | | |
|---|---|---|---|
| 8,931,869 | B2 | 1/2015 | Kawafuji |
| 9,028,032 | B2 | 5/2015 | Tamiya et al. |
| 9,227,442 | B2 | 1/2016 | Tamiya et al. |
| 2013/0286075 | A1 | 10/2013 | Tamiya et al. |
| 2015/0210098 | A1 | 7/2015 | Tamiya et al. |

FOREIGN PATENT DOCUMENTS

| | | | | |
|---|---|---|---|---|
| EP | 0953452 | A2 * | 11/1999 | ..... B41J 2/2135 |
| JP | 2013-240991 | A | 12/2013 | |

* cited by examiner

*Primary Examiner* — Julian D Huffman
(74) *Attorney, Agent, or Firm* — Venable LLP

(57) ABSTRACT

A control unit controls a print head to print a print image by ejecting ink through a nozzle to form dots on a print medium and a movement unit to impart relative movement between the print head and the print medium to print a print image on the print medium. The control unit obtains a dot adjustment value in the predetermined print operation based on the measurement result of a measurement unit measuring a first pattern composed of a print image printed by the predetermined print operation including the relative movement, and a second adjustment value for adjusting dot printing positions in the predetermined print operation in a unit of length shorter than in the adjustment using the first adjustment value based on a second pattern printed by the predetermined print operation in a density according to density information on the first pattern, measured by the measurement unit.

22 Claims, 18 Drawing Sheets

PRINTING APPARATUS, REGISTRATION ADJUSTMENT METHOD, AND STORAGE MEDIUM

BACKGROUND OF THE INVENTION

Field of the Invention

The present invention relates to printing apparatuses that perform printing by forming dots on print media, to registration adjustment methods for adjusting printing positions, and to storage media.

Description of the Related Art

Japanese Patent Laid-Open No. 2013-240991 discloses a technique for serial scan inkjet printing apparatuses to make the landing positions of ink droplets ejected from print heads in agreement between printing in forward scanning and printing in backward scanning. Specifically, in the technique disclosed by Japanese Patent Laid-Open No. 2013-240991, a pattern printed in ink ejected from print heads is read, and adjustment values for making the landing positions of ink droplets in agreement are obtained based on the read results. Here, the printed pattern is read based on the density of the printed pattern. In general, the positional deviation in the landing positions of ejected ink droplets is referred to as registration. In this specification of the present application, adjustment for appropriately adjusting the positional deviations in the landing positions of ejected ink droplets is referred to as "registration adjustment" as appropriate.

Meanwhile, print heads for ejecting ink vary from each other in terms of the amount of ink in an ejected ink droplet and other characteristics due to manufacturing variation in ink characteristics, manufacturing tolerance of ejection openings, and other factors. In addition, each ejection opening changes in the amount of ink in an ejected ink droplet and other characteristics due to swelling by the ink and deterioration over time. Hence, the density of the pattern printed by such print heads may decrease.

In printing apparatuses, light color inks are used in some cases for inks such as cyan, magenta, and yellow to reduce the granularity of dots formed by ink droplets having landed on a print medium. Light color inks and yellow ink have high brightness. Accordingly, dots formed in a light color ink or yellow ink absorb less light than dots formed in other inks such as magenta ink and cyan ink. Hence, for light color inks and yellow ink, the S/N ratio of a portion where dots are formed to a portion where dots are not formed is low in optical characteristic measurement.

The technique disclosed in Japanese Patent Laid-Open No. 2013-240991, thus, has a possibility that printed pattern cannot be read accurately depending on the ink ejection conditions or the type of ink, and that accurate registration adjustment cannot be performed.

SUMMARY OF THE INVENTION

The present invention has been made in light of the above problem and provides a printing apparatus, registration adjustment method, and storage medium that are capable of performing accurate registration adjustment regardless of the ink ejection conditions and the type of ink.

In the first aspect of the present invention, there is provided a printing apparatus comprising:

a print head including a nozzle through which ink is ejected and configured to print a print image by ejecting ink through the nozzle to form dots on a print medium;

a measurement unit configured to measure an optical characteristic of a print image printed on a print medium;

a movement unit configured to impart relative movement between a print medium and the print head;

a first obtaining unit configured to obtain a first adjustment value, based on measurement result of the measurement unit measuring a first pattern that is formed on a print medium and composed of a print image printed by a predetermined print operation including the relative movement, the first adjustment value being for adjusting dot printing positions in the predetermined print operation;

a second obtaining unit configured to obtain a second adjustment value, based on a second pattern printed by the predetermined print operation in a state where dot printing positions of the print head have been adjusted using the first adjustment value, the second adjustment value being for adjusting the dot printing positions at a unit of length shorter than a unit of length at which the printing positions are adjusted using the first adjustment value in the predetermined print operation; and a control unit configured to control the print head and the movement unit to make the print head and the movement unit print a print image on a print medium by the predetermined print operation while applying the first adjustment value and the second adjustment value in the control, wherein the control unit controls the print head based on the measurement result of the first pattern measured by the measurement unit such that the print head prints the second pattern in a density according to density information on the first pattern.

In the second aspect of the present invention, there is provided a registration adjustment method comprising:

a first print step of printing a first pattern by a predetermined print operation including relative movement of a print head that performs printing by ejecting ink through a nozzle to form dots on a print medium;

a first measurement step of measuring the first pattern using a measurement unit capable of measuring an optical characteristic of a print image;

a first obtaining step of obtaining a first adjustment value for adjusting dot printing positions in the predetermined print operation, based on first measurement result in the first measurement step;

a second print step of printing a second pattern having a configuration different from the first pattern, by the predetermined print operation in a state where dot printing positions of the print head have been adjusted using the first adjustment value;

a second obtaining step of obtaining, based on the second pattern, a second adjustment value for adjusting the dot printing positions at a unit of length shorter than a unit of length at which the printing positions are adjusted using the first adjustment value in the predetermined print operation; and a registration adjustment step of adjusting the dot printing positions in the predetermined print operation, based on the first adjustment value and the second adjustment value, wherein in the second print step, the second pattern is printed in a density based on density information on the first pattern, based on measurement result of the first pattern measured in the first measurement step.

In the third aspect of the present invention, there is provided a non-transitory computer readable storage medium storing a program for causing a computer to perform a registration adjustment method comprising:

a first print step of printing a first pattern by a predetermined print operation including relative movement of a print head that performs printing by ejecting ink through a nozzle to form dots on a print medium;

a first measurement step of measuring the first pattern, using a measurement unit capable of measuring an optical characteristic of a print image;

a first obtaining step of obtaining a first adjustment value for adjusting dot printing positions in the predetermined print operation, based on first measurement result in the first measurement step;

a second print step of printing a second pattern having a configuration different from the first pattern, by performing the predetermined print operation in a state where dot printing positions of the print head have been adjusted using the first adjustment value;

a second obtaining step of obtaining, based on the second pattern, a second adjustment value for adjusting the dot printing positions at a unit of length shorter than a unit of length at which the printing positions are adjusted using the first adjustment value in the predetermined print operation; and a registration adjustment step of adjusting the dot printing positions in the predetermined print operation, based on the first adjustment value and the second adjustment value, wherein in the second print step, the second pattern is printed in a density based on density information on the first pattern, based on measurement result of the first pattern measured in the first measurement step.

The present invention makes it possible to perform proper registration adjustment regardless of the ink ejection conditions and the type of ink.

Further features of the present invention will become apparent from the following description of exemplary embodiments with reference to the attached drawings.

DESCRIPTION OF THE EMBODIMENTS

Hereinafter, examples of a printing apparatus, registration adjustment method, and storage medium according to the present invention will be described in detail with reference to the attached drawings. Note that "printing" in the specification of this application includes not only forming meaningful information such as text and figures but also forming meaningless information. In addition, it also broadly includes forming images, designs, and patterns, and the like on a print medium and processing a medium, whether or not they are visible so that humans can see them.

Examples of "print media" include not only paper, which is used for common printing apparatuses, but also broadly include what is capable of receiving ink, such as cloth, plastic film, metal plates, glass, ceramics, wood, and leather. In addition, "ink" should be broadly interpreted in the same way as in the above definition of "printing". Hence, "ink" means liquid that is applied onto a print medium to form images, designs, patterns, and the like or to process a print medium, or liquid that can be provided for ink processing (for example, solidification, insolubilization, or the like of colorants in ink that is applied to a print medium). Further, "nozzles" comprehensively mean ejection openings for ejecting ink, liquid paths communicating with the ejection openings, and elements for generating energy used for ejecting ink, unless otherwise noted.

First Embodiment

A first embodiment of a printing apparatus according to the present invention will be first described with reference to FIGS. 1 to 12C.

Configuration of Printing Apparatus

Figure 1A:
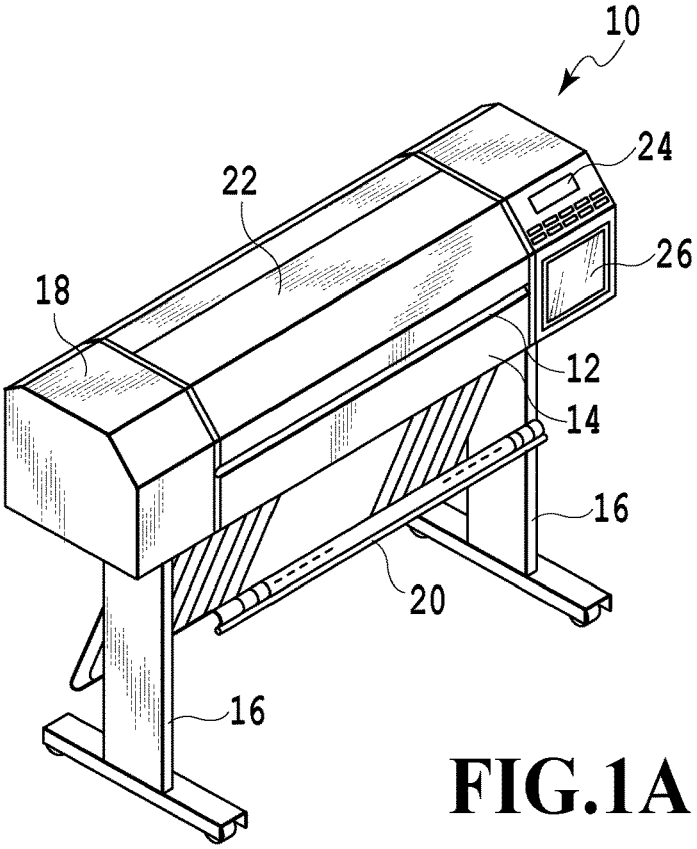
FIGS. 1A and 1B are schematic configuration diagrams of a printing apparatus according to the present invention.
Figure 1B:
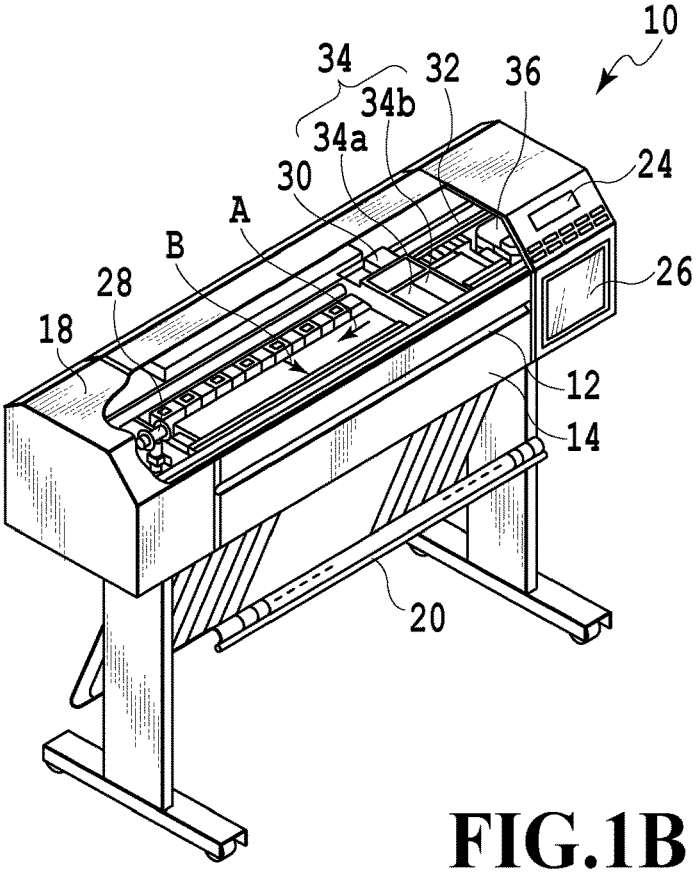

FIG. 1A is a schematic configuration diagram of a printing apparatus according to the present invention. FIG. 1B is a view of the printing apparatus in FIG. 1A shown with an upper part cut away.

The printing apparatus 10 illustrated in FIGS. 1A and 1B is a printing apparatus capable of printing a print image on a large print medium, for example, of A0 size, B0 size, or the like. The printing apparatus 10 has a manual insertion slot 12 on the front face and a rolled-paper cassette 14 that is disposed under the manual insertion slot 12 and openable to the front. A print medium such as print paper or the like is fed to the inside of the printing apparatus 10 through the manual insertion slot 12 or from the rolled-paper cassette 14. The printing apparatus 10 includes a main body 18 supported by a pair of legs 16, a stacker 20 capable of storing print media discharged and stacked on it, an openable upper cover 22 through which the inside is visible. The printing apparatus 10 also includes, at one end of the main body 18 extending in a predetermined direction, an operation unit 24 that the user can operate and an ink tank 26 detachably provided and capable of storing ink to be supplied to print heads 34 (described later).

The printing apparatus 10 has a conveyance roller 28 for conveying a print medium in the arrow-B direction intersecting (orthogonal to, in the present embodiment) the predetermined direction in which the main body 18 extends. The printing apparatus 10 also includes a carriage 30 guided and supported so that carriage 30 can reciprocate in the arrow-A direction in parallel with the predetermined direction. The carriage 30 reciprocates in the arrow-A direction by means of a carriage belt 32 driven by the driving force of a carriage motor 54 (see FIG. 2). The carriage 30 has the print heads 34 which are for ejecting ink to a print medium and are detachably provided. Thus, the print heads 34 are capable of reciprocating in the arrow-A direction in the printing apparatus 10 by means of the carriage 30. The printing apparatus 10 further includes an ink recovery unit 36 of a suction type for resolving ink ejection failure caused by nozzle clogging of the print heads 34 or other factors. Note that in the following description, the arrow-A direction in which the carriage 30 reciprocates is referred to as the "main scanning direction", and the arrow-B direction intersecting the arrow-A direction is referred to as the "sub scanning direction".

In the present embodiment, the carriage 30 has two print heads 34*a* and 34*b* parallelly provided along the arrow-A direction. The print heads 34*a* and 34*b* each have the same configuration and eject six color inks in this embodiment. It means that the carriage 30 includes the print heads 34 capable of ejecting 12 color inks for performing color printing on a print medium.

When the printing apparatus 10 performs printing on a print medium, first, the conveyance roller 28 conveys a print medium to a print start position. Next, a print operation is performed on the print medium while the print heads 34 are scanning in the main scanning direction, moving together with the carriage 30. After that, a conveyance operation is performed in which the conveyance roller 28 conveys the print medium by a predetermined length. In this way, printing is performed on a print medium by repeatedly performing a print operation and a conveyance operation alternately. The print medium on which printing has been finished is discharged to the stacker 20. In the printing apparatus 10, the print heads 34 function as a print unit, and the conveyance roller 28 and the carriage 30 function as a movement unit that relatively moves the print heads 34 with respect to the print medium. Note that in the printing apparatus 10, the main scanning direction is the relative movement direction.

Hardware Configuration of Control System

Figure 2:
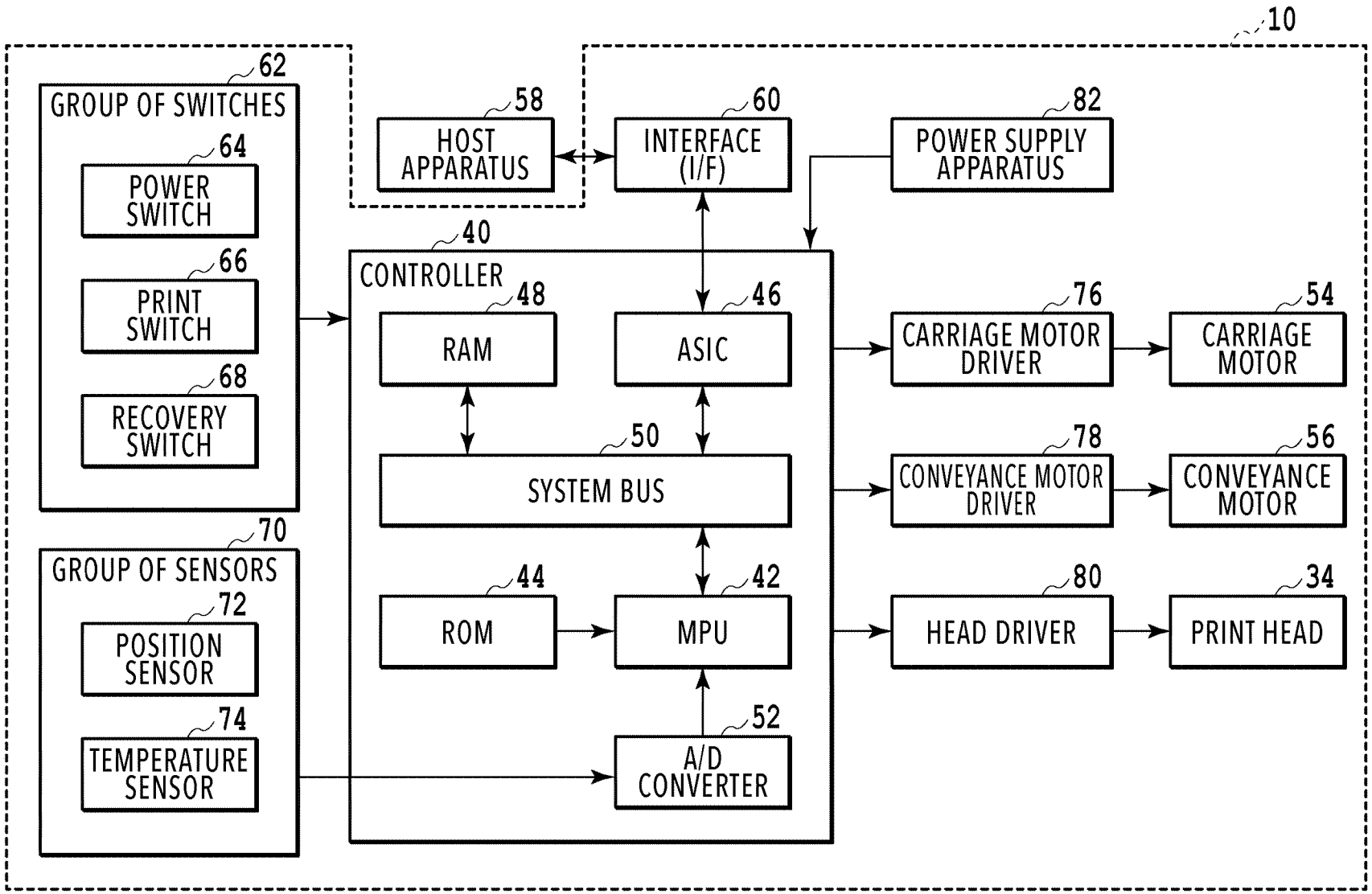
FIG. 2 is a block diagram illustrating the hardware configuration of the control system of the printing apparatus.

Next, the hardware configuration of the control system for implementing printing in the printing apparatus 10 will be described. FIG. 2 is a block diagram illustrating the hardware configuration of the control system for implementing printing in the printing apparatus 10.

The printing apparatus 10 includes a controller 40 that controls the entire operation. The controller 40 includes an MPU 42, ROM 44, an application specific integrated circuit (ASIC) 46, RAM 48, a system bus 50, and an A/D converter 52. The ROM 44 stores programs for performing various processes, predetermined tables, other fixed data, and the like. The ASIC 46 generates control signals or the like for controlling the carriage motor 54, a conveyance motor 56 that drives the conveyance roller 28, and the print heads 34. The RAM 48 is used for a rendering area for image data, a work area executing programs, and other purposes. The system bus 50 interconnects the MPU 42, the ASIC 46, and the RAM 48 and performs data transmission and reception. The A/D converter 52 receives analog signals from a group of sensors 70 described later and performs A/D conversion on the analog signals to supply digital signals to the MPU 42.

The printing apparatus 10 is connected via an interface (I/F) 60 to a host apparatus 58 which is the supply source of image data. The host apparatus 58 can be, for example, a general-purpose personal computer, a reader for reading images, a digital camera, or the like. The host apparatus 58 exchanges image data, commands, status signals, and the like with the printing apparatus 10 via the I/F 60. Image data is inputted, for example, in a raster format.

The printing apparatus 10 has a group of switches 62 including multiple switches that receive instructions from the user and output switch signals to the controller 40. The group of switches 62 includes, for example, a power switch 64 for powering on the printing apparatus 10, a print switch 66 for instructing the start of a print operation, and a recovery switch 68 for instructing the execution of a recovery process for the print heads 34. The printing apparatus 10 has the group of sensors 70 including multiple sensors that detect the state of the printing apparatus 10 and output detection signals. The group of sensors 70 includes, for example, a position sensor 72 for detecting the position of the print medium in the conveying path and a temperature sensor 74 for detecting the temperature of the printing apparatus 10. Further, the printing apparatus 10 has a power supply apparatus 82. The power supply apparatus 82 supplies power to the components of the printing apparatus 10 that require electric power to operate, such as the controller 40.

The controller 40 outputs control signals to the carriage motor 54 via a carriage motor driver 76 to control the scanning of the carriage 30 in the main scanning direction. The controller 40 also outputs control signals to the conveyance motor 56 via a conveyance motor driver 78 to control the conveyance of the print medium by the conveyance roller 28.

The controller 40 outputs control signals to the print heads 34 via a head driver 80 to control the ink ejection and other operations of the print heads 34. Specifically, when the print heads 34 perform printing, the ASIC 46 in the controller 40, for example, outputs signals for driving print elements for ink ejection, such as heaters, to the print heads 34 while the ASIC 46 is directly accessing the storage area of the RAM 48.

Detailed Configuration of Carriage and Its Surroundings

Figure 3:
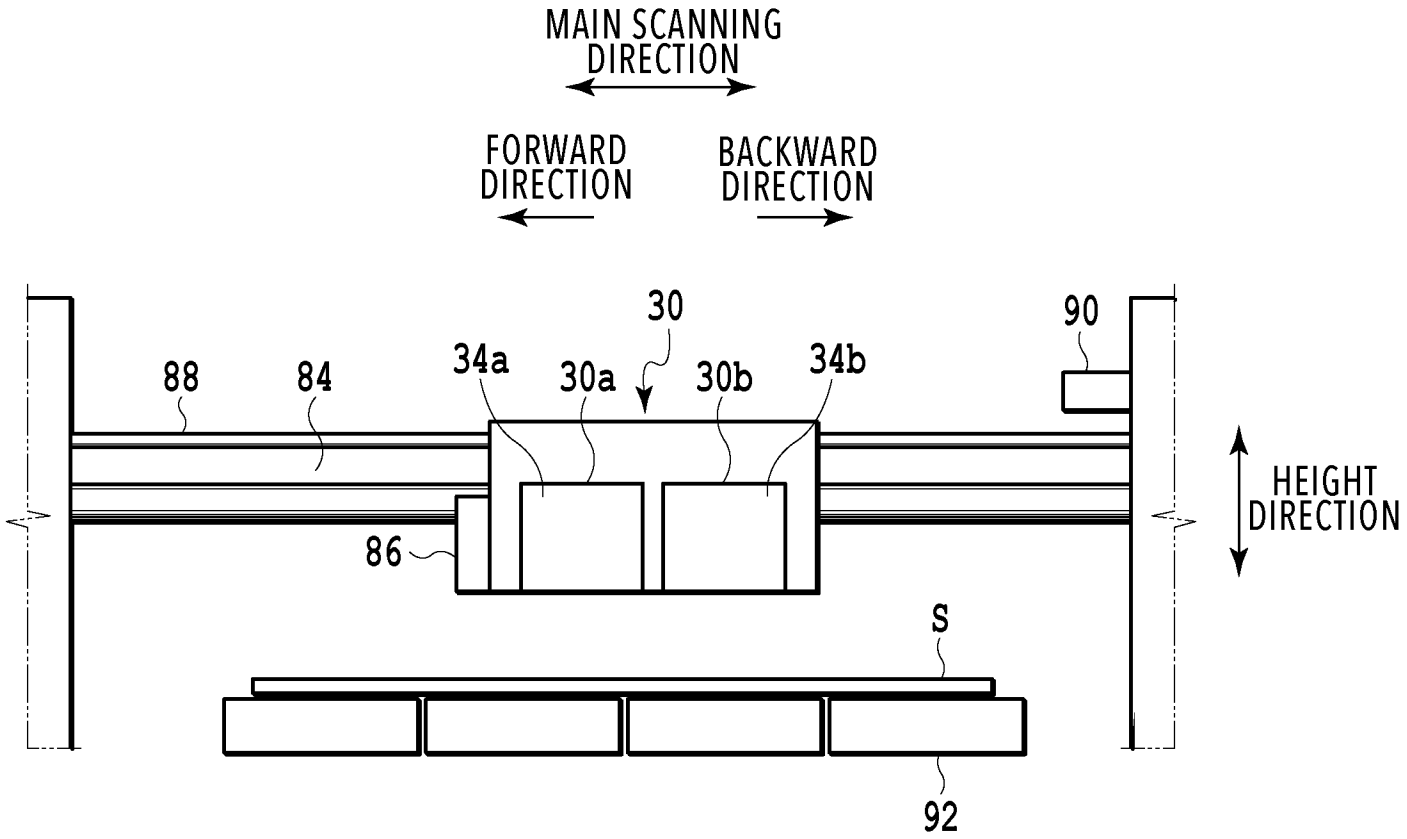
FIG. 3 is a schematic diagram illustrating the configuration of a carriage and its vicinities.

Next, the configuration of the carriage 30 and its surroundings in the printing apparatus 10 will be described. FIG. 3 is a front view diagram schematically illustrating the configuration of the carriage 30 and its surroundings in the printing apparatus 10. The carriage 30 is supported by a shaft 84 extending in the main scanning direction such that the carriage 30 can reciprocate. The carriage 30 has mounting portions 30*a* and 30*b* that the print heads 34 can be attached to and detached from. The print heads 34*a* and 34*b* are mounted to these mounting portions 30*a* and 30*b*, respectively. The carriage 30 also has a reflection sensor 86 on its downstream side in the forward direction of the main scanning direction. The reflection sensor 86 is capable of measuring optical characteristics of the print image printed on the print medium. With this configuration, the reflection sensor 86 is capable of reciprocating in the main scanning direction by moving together with the carriage 30. In the printing apparatus 10, the conveyance roller 28 and the carriage 30 function as a movement unit that relatively move the reflection sensor 86 with respect to the print medium. Meanwhile, the operation of the conveyance roller 28 and the carriage 30 is controlled by the controller 40 as illustrated in FIG. 2. Thus, the controller 40 functions as a control unit that controls the movement of the above movement unit, in other words, the movement of the conveyance roller 28, the carriage 30 and the print heads 34.

The carriage 30 has an encoder 118 (see FIG. 5B), which reads a scale 88 provided along the main scanning direction. The count value read by the encoder 118 is reset by an origin sensor 90 positioned at the most upstream side of the movement range of the carriage 30 in the forward direction of the main scanning direction. Thus, the count value counted by the encoder 118 is the one counted from the position of the origin sensor 90.

The print medium S is conveyed by the conveyance roller 28 and then held on a flat platen 92, being pressed by a pinch roller (not illustrated). Since the present embodiment is capable of printing print media S of large sizes such as A0 and B0, the platen 92 is long in the main scanning direction and composed of multiple pieces.

Configuration of Print Head

Figure 4B:
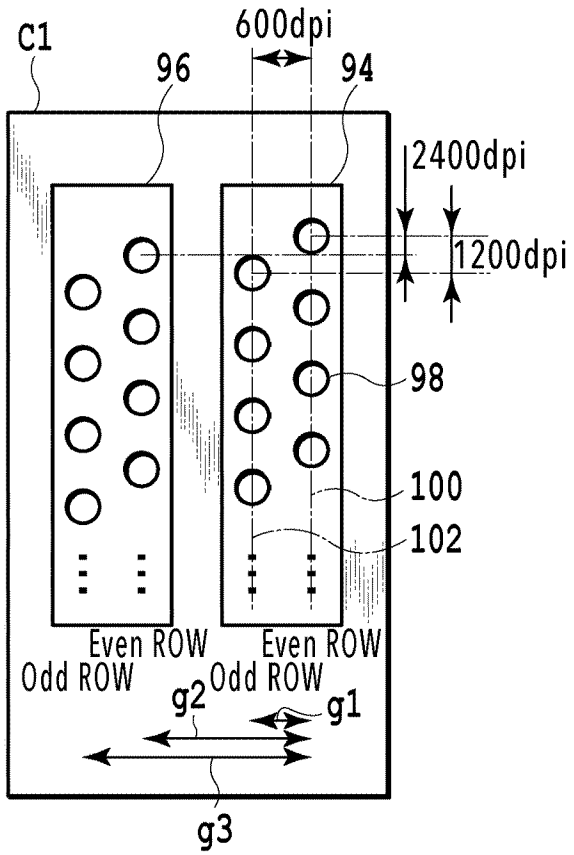
FIGS. 4A and 4B are diagrams for explaining the configuration of nozzle arrays in a print head.
Figure 4A:
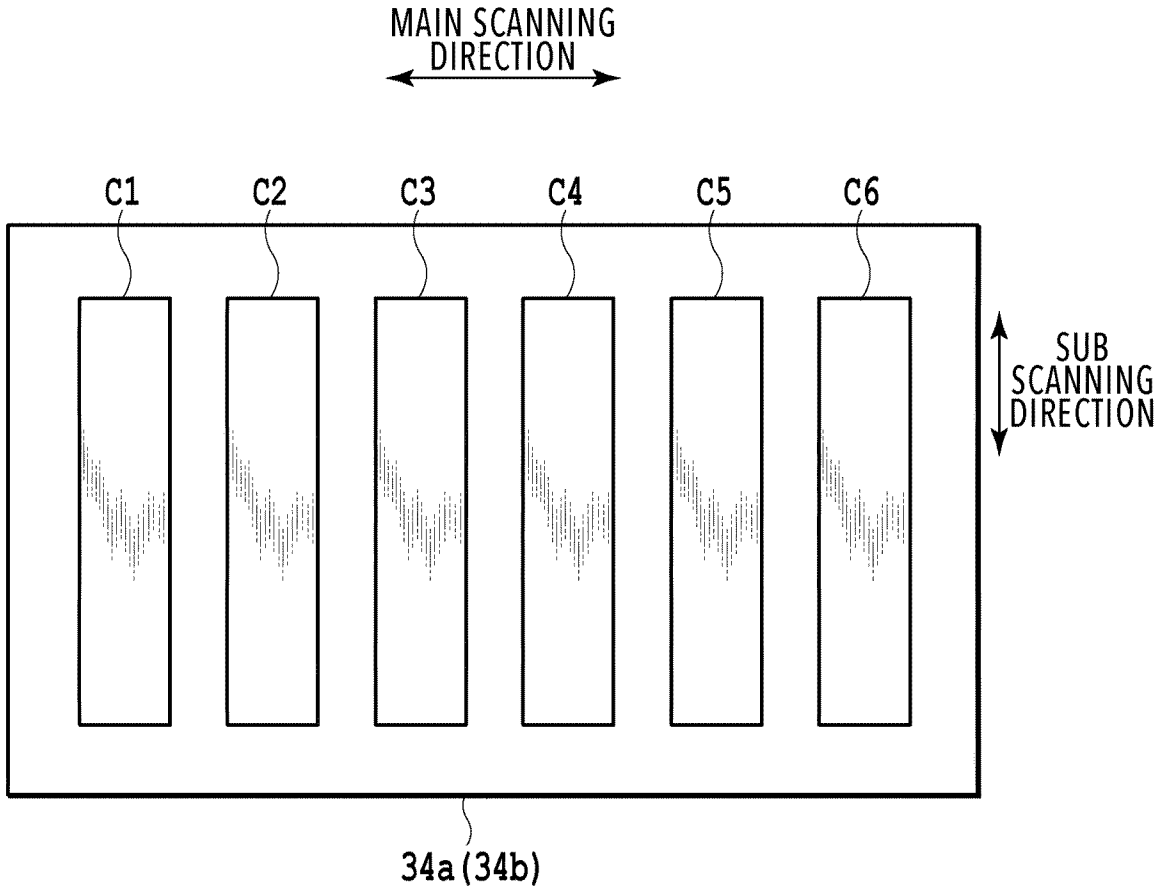

Next, the configuration of the print head 34 will be described. FIG. 4A is a bottom view of the print head 34. FIG. 4B is an enlarged configuration diagram illustrating a chip provided in the print head 34. The print heads 34*a* and 34*b* have the same configuration. Hence, in the following description, the configuration of the print head 34*a* will be described in detail, and the print head 34*b* will be described only with regard to differences from the print head 34*a*.

The print head 34*a* has six chips C1 to C6, and each chip ejects a different kind of ink. Each of the chips C1 to C6 has the same configuration. Since the printing apparatus 10 has the print heads 34*a* and 34*b* mounted on the carriage 30, the printing apparatus 10 is capable of ejecting 12 color inks in total. The 12 colors are, for example, BK (black), C (cyan), M (magenta), Y (yellow), PC (light cyan), PM (light magenta), GY (gray), MBK (pigment black), PGY (light gray), R (red), G (green), and B (blue).

The chips C1 to C6 are parallelly provided along the main scanning direction such that each chip extends in the sub scanning direction in the state where the print head 34*a* is mounted on the carriage 30. The chips C1 to C6 each have two nozzle arrays 94 and 96. The nozzle arrays 94 and 96 each have two rows of multiple nozzles 98 arranged along the sub scanning direction. Of the two rows, one row is shifted relative to the other row in the sub scanning direction. Here, in each nozzle array, each nozzle is numbered from one end toward the other end in the sub scanning direction, and the row consisting of nozzles of odd numbers is referred to as the even row 100 and the row consisting of nozzles of even numbers is referred to as the odd row 102. Note that the arrangement direction in which the nozzles 98 are arranged in the nozzle arrays 94 and 96 is only required to intersect with the main scanning direction and is not limited to the sub scanning direction.

The distance between the even row 100 and the odd row 102 corresponds to the resolution of 600 dpi. Note that dpi (dots per inch) means dot density, in other words, resolution. The odd row 102 is shifted to the other end side in the sub scanning direction relative to the even row 100 by the length corresponding to the resolution of 1200 dpi. Further, the even row 100 and the odd row 102 of the nozzle array 96 are shifted to the other end side in the sub scanning direction relative to the even row 100 and the odd row 102 of the nozzle array 94 by the length corresponding to the resolution of 2400 dpi. Thus, the print head 34*a* is capable of printing in the resolution of 2400 dpi in the sub scanning direction. Since the nozzle rows are arranged to be relatively shifted from one another in a chip on the print head 34 as described above, the print head 34 can form images in high resolution.

In the print heads 34*a* and 34*b* when printing, each nozzle is driven at a different ejection timing according to the distance between the nozzle rows such that ink ejected by the nozzles with the same nozzle number in each nozzle array in each chip can land on the same position on a print medium. The distances between nozzle rows are, for example, distance g1 between the even row 100 and the odd row 102 of the nozzle arrays 94 and 96, distance g2 between the even rows 100 of the nozzle arrays 94 and 96, and distance g3 between the even row 100 of the nozzle array 94 and the odd row 102 of the nozzle array 96.

However, the distance between nozzle rows in each print head 34 is varied depending on manufacturing tolerance or other factors, and the landing positions of ejected ink droplets, in other words, the printing positions at which dots are formed have positional deviation, accordingly. Hence, registration adjustment needs to be performed to eliminate the positional deviation in the landing positions of ejected ink droplets. In the registration adjustment, adjustment values are obtained, and the ejection timings of ink droplets and the like are adjusted using the obtained adjustment values. For printing apparatuses that perform bidirectional printing in which printing is performed during the movement of the print heads 34 in the forward and backward directions, not only registration adjustment between different two rows needs to be performed, but also registration adjustment between the forward direction and the backward direction needs to be performed for predetermined nozzle rows.

Registration Adjustment

Types of Registration Adjustment

In the registration adjustment, adjustment values are obtained with which the timing of ejecting ink droplets in a target nozzle row can be adjusted such that the landing positions of ink droplets from the target nozzle row agrees with the landing positions of ink droplets from a reference nozzle row. There are several adjustment values depending on the adjustment target. For example, they are the adjustment value for adjustment between even and odd rows, the adjustment value for adjustment between nozzle arrays, the adjustment value for adjustment between forward and backward movements, and the adjustment value for adjustment between chips.

The adjustment value for adjustment between even and odd rows is one for adjusting the positional deviation in the landing positions of ink droplets between the even row 100 (first row) and the odd row 102 (second row) in the nozzle array. Specifically, it is an adjustment value for adjusting, for example, the ink ejection timing of the odd row 102 such that the landing positions on the print medium of ink droplets ejected from the even row 100 and the odd row 102 agree with one another. An adjustment values is obtained for each of the chips Cl to C6.

The adjustment value for adjustment between nozzle arrays is one for adjusting the positional deviation in the landing positions of ink droplets between the nozzle array 94 (first nozzle array) and the nozzle array 96 (second nozzle array). Specifically, it is an adjustment value for adjusting, for example, the ink ejection timing of the even row 100 of the nozzle array 96 such that the landing positions on the print medium of ink droplets ejected from the even rows 100 of the nozzle arrays 94 and 96 agree with one another. An adjustment values is obtained for each of the chips C1 to C6.

The adjustment value for the odd rows 102 can be obtained by summing the adjustment value for adjustment between nozzle arrays and the adjustment value for adjustment between even and odd rows for each of the nozzle arrays 94 and 96.

The adjustment value for adjustment between forward and backward movements is one for adjusting the positional deviation in the landing positions of ink droplets between in printing in the forward direction (first direction) and in printing in the backward direction (second direction). Specifically, it is an adjustment value for adjusting, for example, the ink ejection timing of the even row 100 of the nozzle array 94 in printing in the backward direction such that the landing positions on the print medium of ink droplets ejected from the even row 100 of the nozzle array 94 in printing in the forward direction and in printing in the backward direction agree with one another. An adjustment values is obtained for each of the chips C1 to C6.

The adjustment value for adjustment between chips is one for adjusting the positional deviation in the landing positions of ink droplets between a reference chip and a target chip. Specifically, it is an adjustment value for adjusting, for example, the ink ejection timing of the even row 100 of the nozzle array 94 in a target chip such that the landing positions of ink droplets ejected from the even rows 100 in the nozzle arrays 94 of the reference chip and the target chip agree with one another. For example, a chip that ejects black ink is defined as the reference chip.

Configuration for Registration Process

Figure 5B:
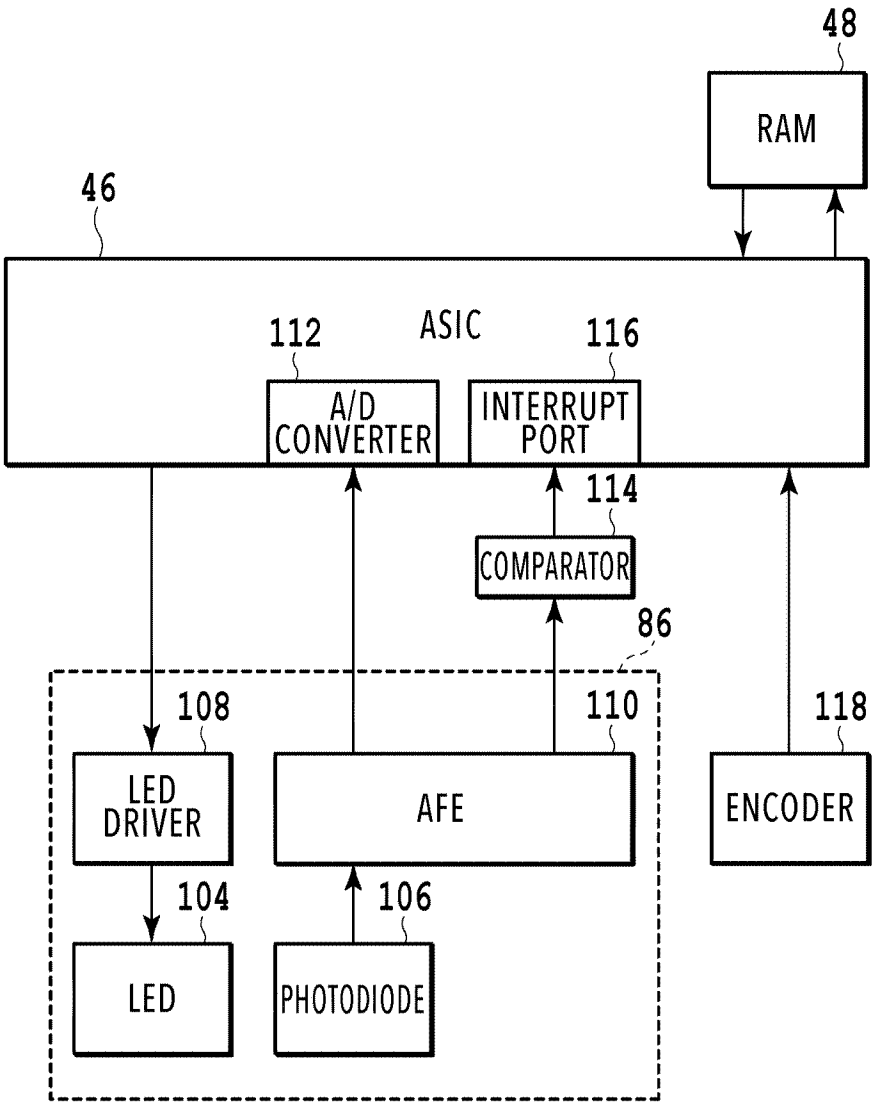
FIGS. 5A and 5B are diagrams for explaining the configuration of a reflection sensor.
Figure 5A:
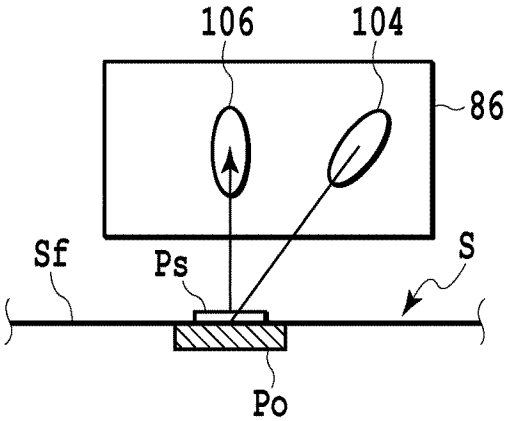

FIG. 5A is a diagram illustrating the configuration of the reflection sensor 86 used for the registration process to obtain adjustment values for registration adjustment. FIG. 5B is a diagram illustrating the hardware configuration of the control system of the reflection sensor 86.

The printing apparatus 10 performs a measurement operation for measuring print images on the print medium by relatively moving the reflection sensor 86 with respect to the print medium using the conveyance roller 28 and the carriage 30. The reflection sensor 86 includes an LED 104 for projecting light to the print surface Sf of the print medium S on which ink has been ejected and a photodiode 106 for receiving the reflection light from the print surface Sf. The light projection area of the LED 104 and the light detection area of the photodiode 106 overlap with each other on the reflection surface (print surface Sf) and form a detection spot Ds. The size of the detection spot Ds in the present embodiment is 5 mm×5 mm, but the size of the detection spot Ds is not limited to this size. The reflection sensor 86 projects light to a patch $P_0$ formed on the print surface Sf and detects the level of the reflection intensity reflecting the density of the patch $P_0$. For example, for patches Po of the same color, the lower the density, the higher the reflection intensity, and the higher the density, the lower the reflection intensity.

The operation of the reflection sensor 86 is controlled by the ASIC 46. The LED 104 is capable of selectively emitting light of three primary colors: R (red), G (green), and B (blue). The LED 104 is controlled by an LED driver 108 and capable of changing the color of light that it emits according to the color of a patch to be detected. The photodiode 106 outputs light-reception signals based on a light-reception result to an analog processing unit (AFE: analog front end) 110. The AFE 110 performs signal amplification, low-pass filtering for noise reduction, and other processing on the inputted light-reception signals.

The analog signals processed in the AFE 110 are converted by an A/D converter 112 in the ASIC 46 into digital signals, which are inputted to the ASIC 46. The analog signals processed in the AFE 110 are also inputted to a comparator 114, and the signals outputted from the comparator 114 are inputted to an interrupt port 116 in the ASIC 46 as interrupt signals.

The ASIC 46 works together with the MPU 42 to synchronize the output signals from the reflection sensor 86 with the position signals from the encoder 118 and processes the signals from the reflection sensor 86 as density detection signals corresponding to the position of the carriage 30. The ASIC 46 is connected to the RAM 48, which stores read data on patches and count values outputted from the encoder 118. In the printing apparatus 10, the reflection sensor 86 functions as a measurement unit that measures print images printed on a print medium.

Registration Process

Figure 6:
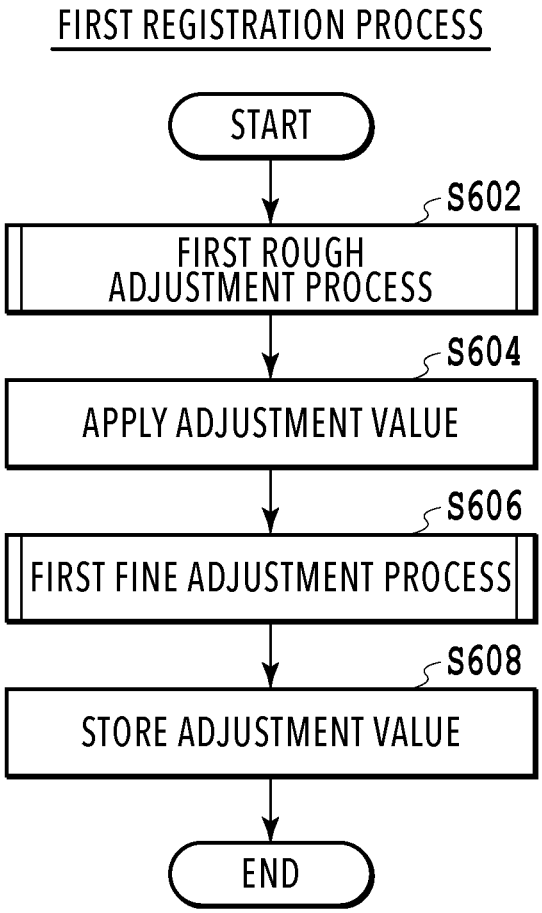
FIG. 6 is a flowchart illustrating process details of a first registration process.
Figure 7:
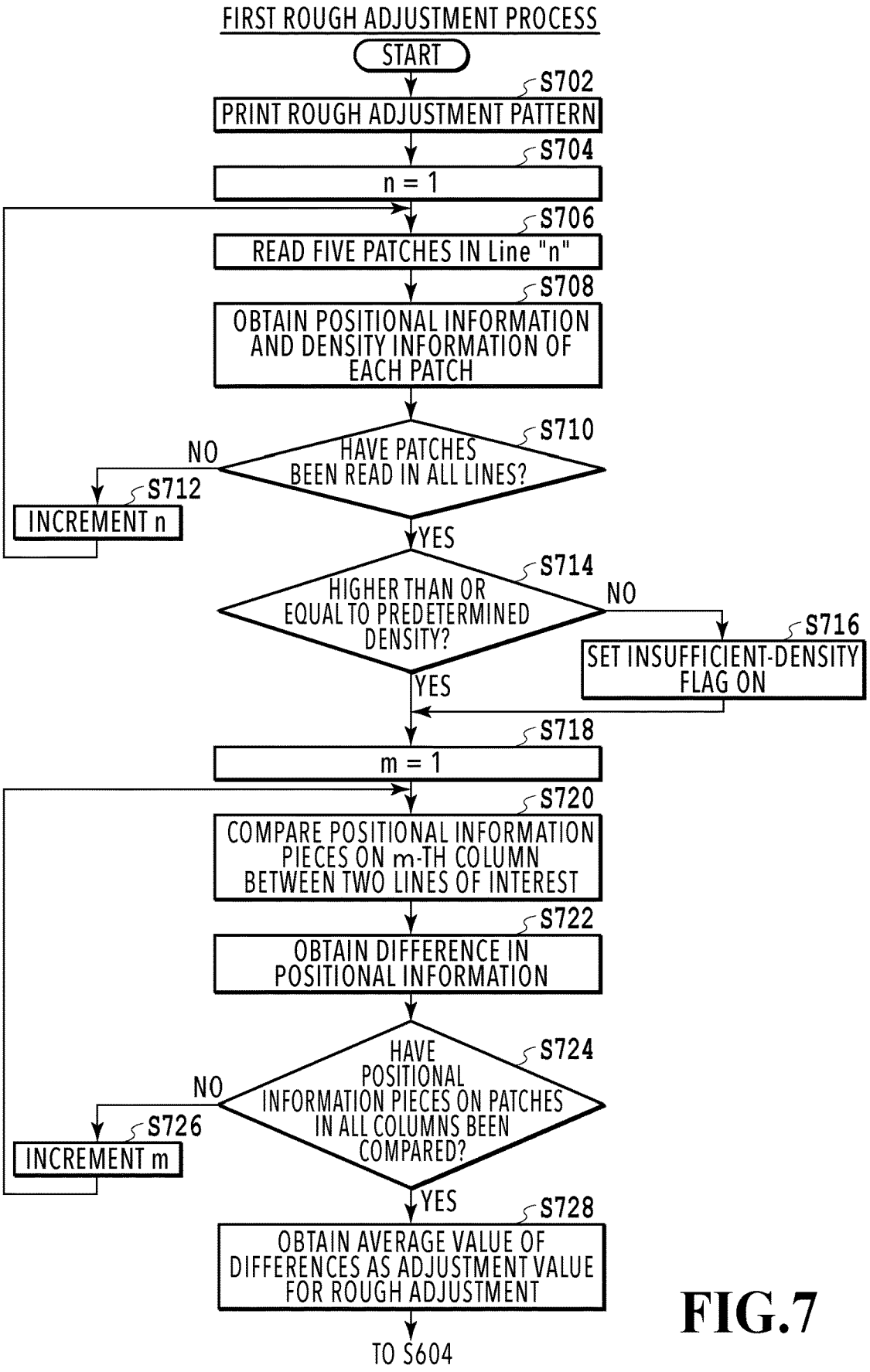
FIG. 7 is a flowchart illustrating process details of a first rough adjustment process.
Figure 8:
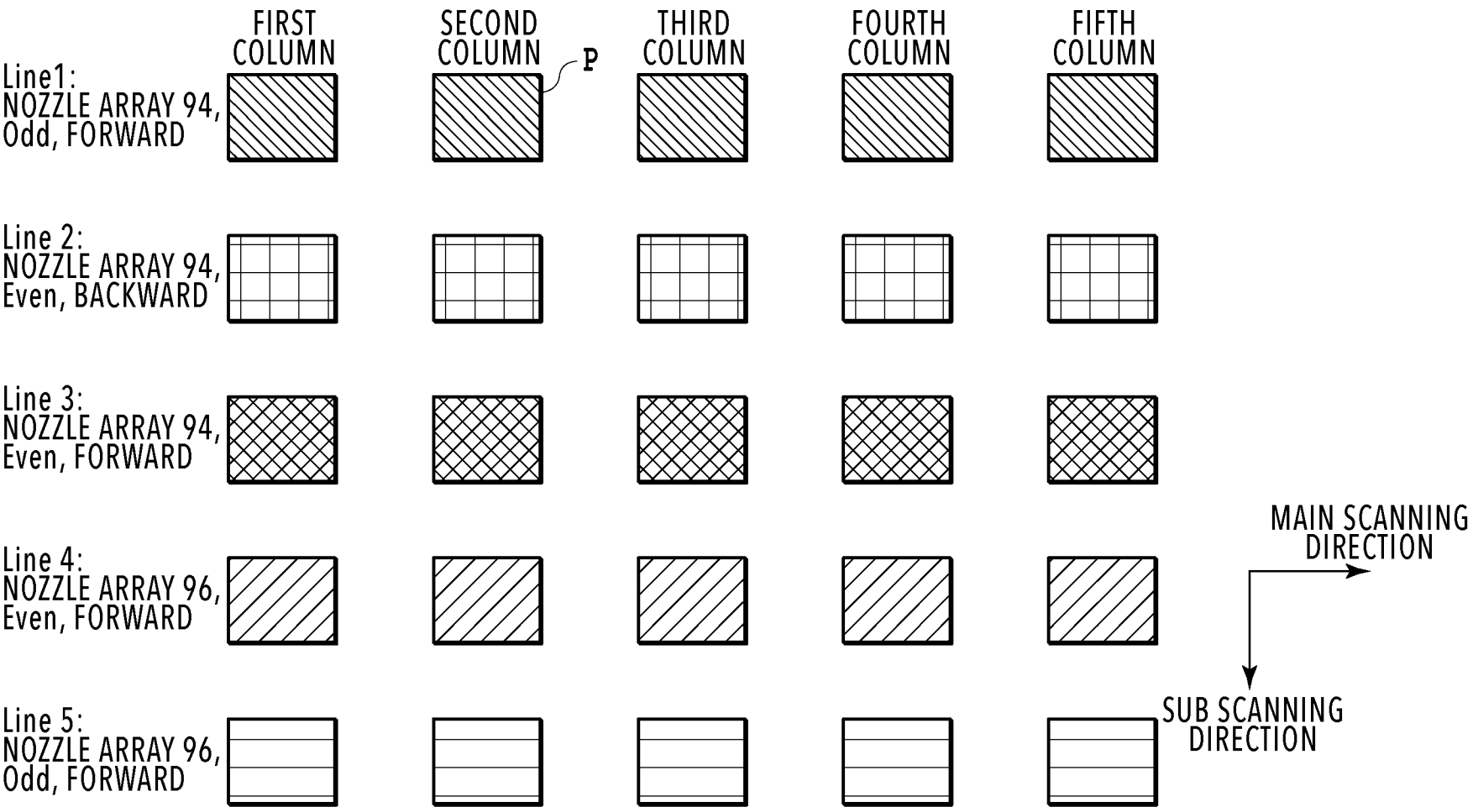
FIG. 8 is a diagram illustrating a rough adjustment pattern used in the first rough adjustment process.
Figure 9B:
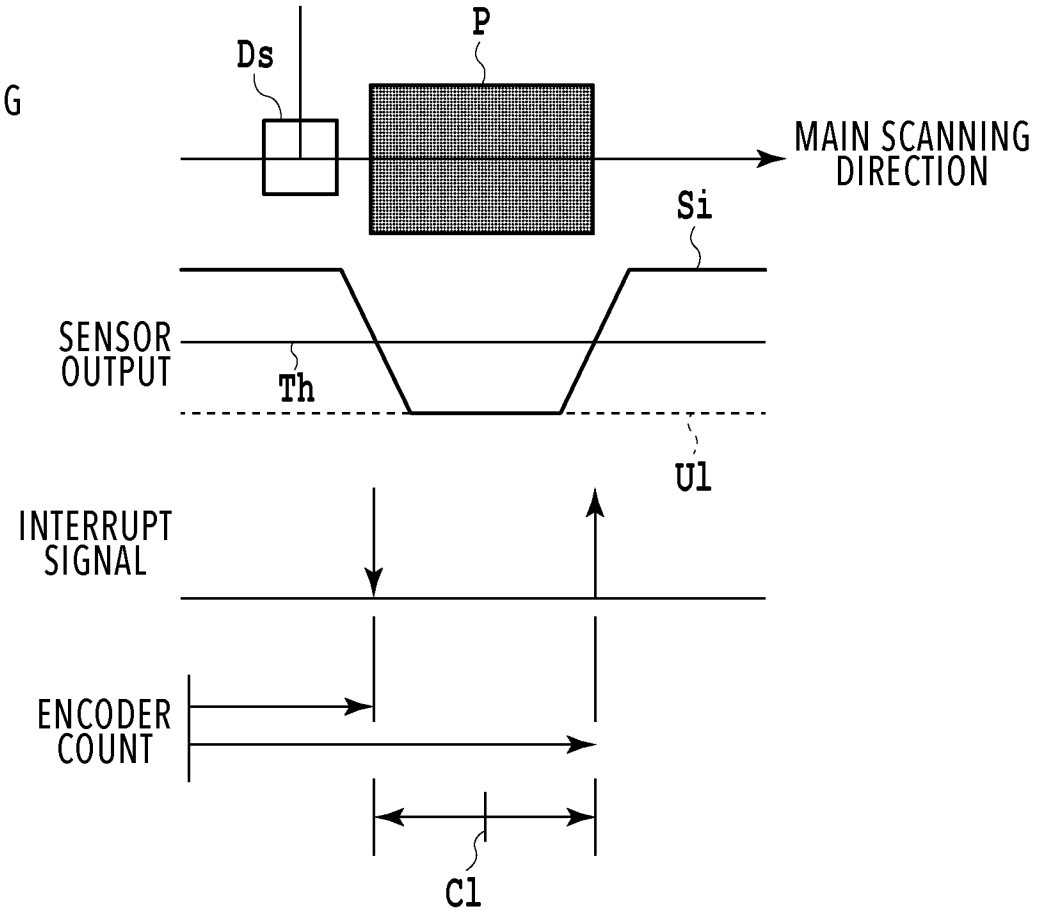
FIGS. 9A and 9B are diagrams for explaining a patch in the rough adjustment pattern and how the patch is read.
Figure 9A:
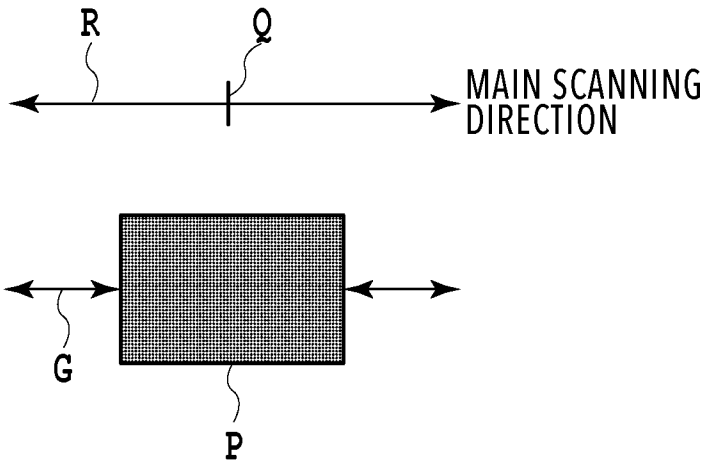
Figure 10:
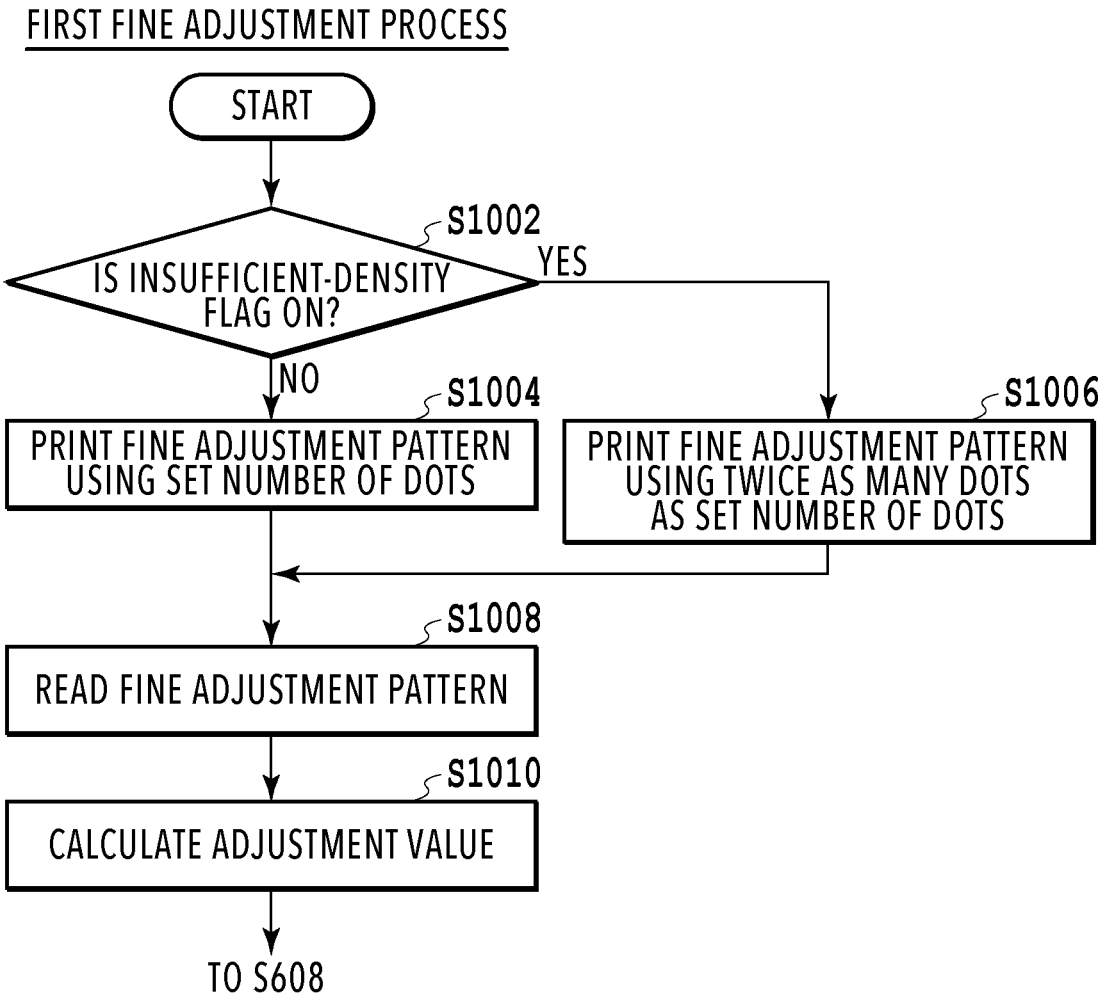
FIG. 10 is a flowchart illustrating process details of a first fine adjustment process.

Next, a first registration process performed by the printing apparatus according to the first embodiment will be described with reference to FIGS. 6 to 12C. FIG. 6 is a flowchart illustrating process details of the first registration process. FIG. 7 is a flowchart illustrating process details of a first rough adjustment process in the first registration process. FIG. 8 is a diagram illustrating rough adjustment patterns. FIG. 9A is a diagram illustrating the aiming position of a patch and the detection range. FIG. 9B is a diagram illustrating changes of a detection signal at the time when the reflection sensor 86 detects a patch. FIG. 10 is a flowchart illustrating process details of a first fine adjustment process in the first registration process.

In the first registration process performed in the printing apparatus 10, the landing positions of ink droplets are adjusted in two steps as illustrated in FIG. 6. Specifically, first, a rough adjustment process is performed using a distance detection method having a wide adjustment range for adjustment values. After that, in the state where the adjustment values obtained in the rough adjustment process are applied, adjustment values are obtained by performing a fine adjustment process using a density method that has a narrow adjustment range for adjustment values but has high adjustment accuracy. Note that the state where adjustment values are applied means the state where the landing positions of ink are adjusted using the adjustment values. A series of processes illustrated in the flowcharts of the first registration process in FIG. 6, the first rough adjustment process in FIG. 7, and the first fine adjustment process in FIG. 10 is performed by the MPU 42 loading programs stored in the ROM 44 into the RAM 48. Alternatively, part or all of the functions of the steps in the flowcharts may be implemented using hardware such as an ASIC or an electronic circuit.

When the user gives the instruction to start the first registration process, for example, via the host apparatus 58, the printing apparatus 10 starts the first registration process illustrated in FIG. 6. When the first registration process starts, first, the first rough adjustment process is performed (S602). In the first rough adjustment process, first, a rough adjustment pattern (first pattern) including multiple patches is printed as illustrated in FIG. 7 (S702). Note that when the first rough adjustment process starts, an insufficient-density flag is initialized to be set off. The rough adjustment pattern includes five patches P printed in the same condition in each line (hereinafter also referred to as "Line") having one of five kinds in which the scanning directions in printing are different or in which used nozzle rows are different. In the present embodiment, the patches P in Line 1 are formed by ejecting ink from the odd row of the nozzle array 94 during the movement in the forward direction. The patches P in Line 2 are formed by ejecting ink from the even row of the nozzle array 94 during the movement in the backward direction. The patches P in Line 3 are formed by ejecting ink from the even row of the nozzle array 94 during the movement in the forward direction. The patches P in Line 4 are formed by ejecting ink from the even row of the nozzle array 96 during the movement in the forward direction. The patches P in Line 5 are formed by ejecting ink from the odd row of the nozzle array 96 during the movement in the backward direction.

Each patch P has a rectangular shape with a uniform density as illustrated in FIG. 9A. The length of the patch P in the main scanning direction is set longer than at least detection spot Ds of the reflection sensor 86. The length of the patch P in the sub scanning direction should preferably be longer than detection spot Ds. The shape of the patch P is a rectangular shape the edge of which is formed to be orthogonal to the main scanning direction which is the movement direction of the carriage 30 so that the signal rise when the reflection sensor 86 detects the edge is sharp. In addition, the higher density the patch P has, the clearer the boundary between the area where the patch is formed and the area where the patch is not formed is, increasing the contrast of the signal received by the reflection sensor 86. For this reason, each patch P is formed to have a high, uniform density.

Each of the patches P is formed such that the aiming position Q of the reflection sensor 86 in the main scanning direction agrees with the patch center. However, the positions of formed patches can have a positional deviation depending on the registration. Hence, the interval G between patches P in the main scanning direction is set to have a margin for such an expected positional deviation. In detecting a patch P, the position of the patch is detected within a detection range R having its center at the aiming position Q.

Next, n is set to 1 (S704), the patches in Line "n" are read in the rough adjustment pattern (S706), and the positional information on the patches are obtained (S708). In S706, the print medium S is moved in the sub scanning direction to a position where the reflection sensor 86 can read the five patches P in Line "n" by moving the carriage 30 in the main scanning direction. Then, the carriage 30 is moved in the main scanning direction, and the reflection sensor 86 reads the five patches P in Line "n".

In S708, on the basis of the detection signals (light-reception signals) of the reflection sensor 86, the controller 40 obtains the positional information and the density information on the five patches Pin Line "n". Here, FIG. 9B shows a measurement result of a patch P by the reflection sensor 86, specifically, changes of a detection signal detected with the center position of the detection spot Ds as the reference. According to these changes, when the patch P gets overlapped with the detection spot Ds, the level of the detection signal Si (light-reception signal) detected decreases. After the entire detection spot Ds gets in the patch P, the level of the detection signal Si becomes stable at a uniform level U1. Here, the comparator 114 compares the detection signal Si with a threshold Th, and when the level of the detection signal Si falls below the threshold Th, an interrupt signal is generated. In FIG. 9B, the threshold Th is the intermediate value between the detection value of the area where the patch P is formed and the detection value of the area where the patch P is not formed. Note that this threshold Th is calculated by measuring the density of each patch in the rough adjustment pattern in advance. The densities of the patches measured at this time are used in density determination in S714 described later.

On the basis of the interrupt signal, the ASIC 46 obtains the position of the carriage 30 determined by the encoder 118 at that time. Since the patch P is detected while the carriage 30 is moving, it is possible to detect the two edge positions which are both sides of the patch P orthogonal to the main scanning direction. The ASIC 46 obtains the center of the detected two edge positions as positional information C1 on the patch P. In addition, the ASIC 46 obtains level U1 (see FIG. 9B) at which the detection signal Si has become uniform as the density information. The obtained positional information is based on the origin position in the main scanning direction. The positional information and density information thus obtained are stored in the RAM 48 being associated with the patch number. Note that the patch number means the serial number assigned to each patch in the rough adjustment pattern.

After that, it is determined whether the patches in all the lines in the rough adjustment pattern have been read (S710). If it is determined that the patches in all the lines have not been read, n is incremented (S712), and the process returns to S706. If it is determined in S710 that the patches in all the lines have been read, it is determined whether the density information on the patches (hereinafter also simply referred to as the "density") is higher than or equal to a predetermined density (S714). The predetermined density is set according to the densities of the patches in the rough adjustment pattern obtained to set the threshold Th, and the details will be described later. In S714, in the case where all the patches P has densities of the predetermined density or more, it is determined that the density of the patches P is higher than or equal to the predetermined density, and in the other cases, it is determined that the density of the patches P is not higher than or equal to the predetermined density, in other words, it is lower than the predetermined density.

In S714, if it is determined that the density of the patches P is lower than the predetermined density, the insufficient-density flag is set on (S716), and the process proceeds to S718 described later. On the other hand, if it is determined in S714 that the density of the patches P is higher than or equal to the predetermined density, the process proceeds to S718 with the insufficient-density flag kept off. In S718, m is set to 1, and positional information pieces on the patches in the m-th column in two lines of interest are compared (S720). In S720, for example, in the case of calculating the adjustment value for adjustment between forward and backward movements, comparison is made between the positional information pieces on the patches in the m-th column in Line 2 and Line 3 for which the same nozzle row was used to eject ink but which were printed in printing in the different scanning directions.

Then, the controller 40 obtains the difference between the two positional information pieces (S722). Specifically, the controller 40 obtains distance information in the main scanning direction of the two patches in the m-th column. In the case where the patch P printed during the forward movement is used as the reference, in S722, the value obtained by subtracting the positional information piece on the patch P in the m-th column in Line 2 from the positional information piece on the patch P in the m-th column in Line 3 is obtained. The obtained difference is associated with the patch numbers and stored in the RAM 48. After that, it is determined whether the patches in all the columns have been compared (S724). If it is determined that the patches in all the columns have not been compared, m is incremented (S726), and the process returns to S720. On the other hand, if it is determined in S724 that all the patches have been compared, the average value of the differences, in other words, the distance information pieces for the respective columns obtained in S722 is obtained as the adjustment value (first adjustment value) in the first rough adjustment process (S728), and the process proceeds to S604. The first rough adjustment process described above is executed by the controller 40. In other words, in the printing apparatus 10, the controller 40 functions as a first obtaining unit that obtains an adjustment value based on the rough adjustment pattern.

Returning to FIG. 6, after the first rough adjustment process finishes, the process proceeds to S604, and the adjustment value obtained in the first rough adjustment process is applied to the printing apparatus 10. Specifically, in the case where the obtained adjustment value is the adjustment value for adjustment between forward and backward movements, the ink ejection timing is adjusted based on the adjustment value for adjustment between forward and backward movements. For ink ejection, ejection pulses are generated based on the position signal from the encoder such that ink droplets will land at target landing positions.

For example, assume that the adjustment value for adjustment between forward and backward movements is "+T", which means printing results in the backward direction are shifted to one end side in the main scanning direction by "T" relative to printing results in the forward direction. Note that in the present embodiment, the forward direction (first direction) is the direction from one end side toward the other end side in the main scanning direction, and the backward direction (second direction), which is opposite to the forward direction, is the direction from the other end side toward the one end side in the main scanning direction. On the basis of the adjustment value for adjustment between forward and backward movements, the adjustment value for adjustment between forward and backward movements is applied to printing in the backward direction such that the landing positions of ink droplets in printing in the backward direction agree with those in the forward direction. Specifically, to make the ink droplets in printing in the backward direction land at positions shifted to the one end side by "T", the ejection pulses are generated when the carriage 30 reaches the position corresponding to a delay of the adjustment value "+T" for adjustment between forward and backward movements. In printing in the backward direction, the carriage 30 moves from the other end side toward the one end side. Thus, the landing positions of the ink droplet ejected with a delay corresponding to the adjustment value "+T" for adjustment between forward and backward movements are shifted to the one end side by the distance corresponding to "T" from the landing positions of the ink droplets that are ejected in the state where the adjustment value for adjustment between forward and backward movements is not applied. As a result, the landing positions of the ink droplets in printing in the forward direction agree with the ones in the backward direction.

After that, the first fine adjustment process is performed in the state where the adjustment value obtained in the first rough adjustment process is applied (S606). After the first fine adjustment process starts, it is first determined whether the insufficient-density flag is on, as illustrated in FIG. 10 (S1002). If it is determined in S1002 that the insufficient-density flag is off, a fine adjustment pattern is printed in a density set in advance (S1004), and the process proceeds to S1008. On the other hand, if it is determined in S1002 that the insufficient-density flag is on, the fine adjustment pattern is printed with an increased number of dots so that the density is higher than the set density set in advance (S1006), and the process proceeds to S1008.

Figure 11A:
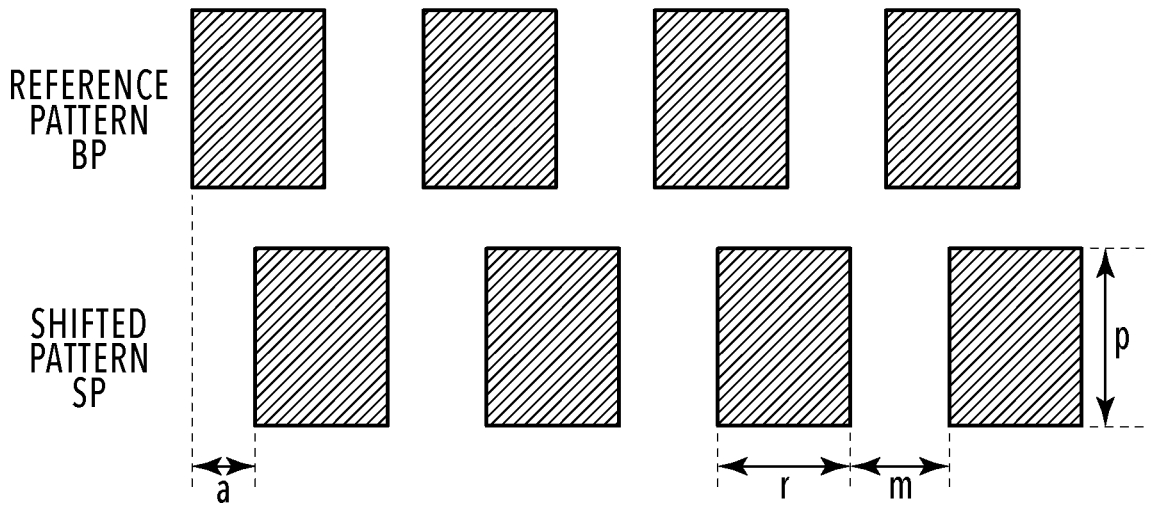
FIGS. 11A and 11B are diagrams for explaining a fine adjustment pattern used in the first fine adjustment process.
Figure 11B:
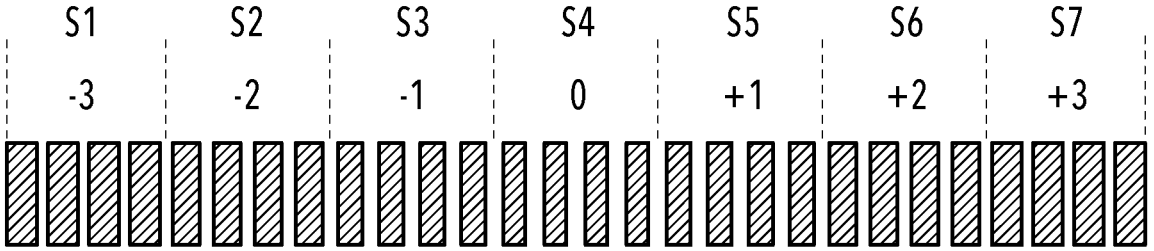

The fine adjustment pattern (second pattern) printed has two overlapped patterns each having rectangular patches repeated cyclically at predetermined intervals. The rectangular patches each have, for example, a size of p pixels×r pixels and is formed to have a uniform density, as illustrated in FIG. 11A. Two adjoining rectangular patches has an interval of m pixels in between. The two patterns are a reference pattern BP and a shifted pattern SP the printing position of which is shifted relative to the reference pattern BP by "a" pixels in the main scanning direction. Note that the resolutions of the two patterns and the amount of shift of the shifted pattern SP relative to the reference pattern BP are determined according to the print resolution of the printing apparatus. It is assumed in the present embodiment that the print resolution is 1200 dpi. In FIG. 11A, the two patterns that are actually printed being overlapped with each other are illustrated being shifted up and down, for easier understanding. In the fine adjustment pattern, multiple patterns are printed in parallel with one another, each having a different amount of shift a of the shifted pattern SP relative to the reference pattern BP which is changed in the main scanning direction. For example, FIG. 11B illustrates a fine adjustment pattern including patterns printed each to have a different amount of shift a changed from −3 pixels to +3 pixels. The fine adjustment pattern is formed to have multiple areas S1 to S7 having different shift amounts and lined in the main scanning direction, as illustrated in FIG. 11B.

In S1004, the fine adjustment pattern is printed using dots the number of which is set in advance. On the other hand, in S1006, the fine adjustment pattern is printed, for example, using twice as many dots as the number of dots set in advance. Specifically, in S1006, the image data of the fine adjustment pattern is the same, but the number of printing scans for printing the fine adjustment pattern is doubled. Specifically, printing based on the same image data is performed twice to double the number of dots printed at the same position on a print medium.

When the fine adjustment pattern is printed, in the case of making the landing positions of ink droplets of the two nozzle rows in agreement, a reference pattern BP is printed with one nozzle row, and a shifted pattern SP is printed with another nozzle arrow. In the case of making the landing positions of ink droplets during the forward and backward movements in agreement, a reference pattern BP is printed during the movement in the forward direction, and a shifted pattern SP is printed during the movement in the backward direction.

After the fine adjustment pattern is printed, next, the printed fine adjustment pattern is read (S1008), an adjustment value is calculated based on the read information (S1010), and the process proceeds to S608. Meanwhile, for each area in the fine adjustment pattern, if the amount of shift between two patterns is changed, the area ratio of the print area to the print medium changes. Hence, to make in agreement the landing positions of ink droplets between the two nozzle rows or between the frontward and backward directions, the ink ejection timing needs to be shifted by the amount that makes the density of the fine adjustment pattern lowest.

Figure 12A:
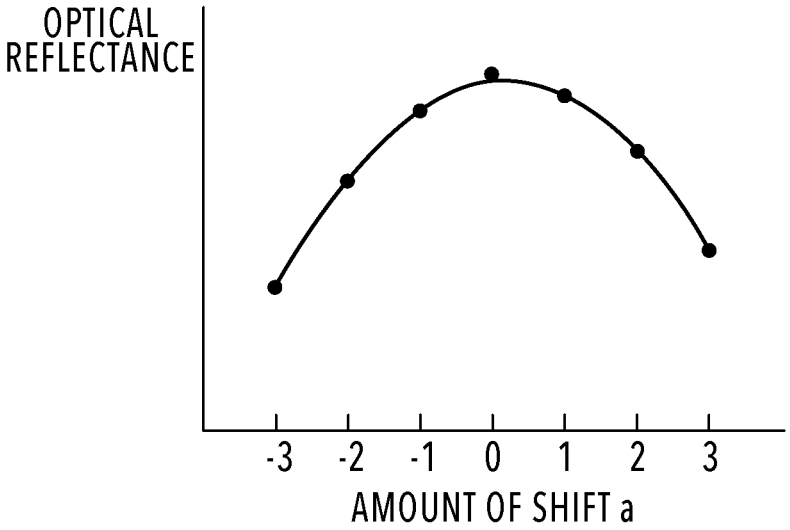
FIGS. 12A, 12B, and 12C are diagrams illustrating the difference in density in each area of the fine adjustment pattern.

In S1008, the reflection sensor 86 reads the fine adjustment pattern to read the density information on each area. For example, for the fine adjustment pattern in FIG. 11B, the controller 40 obtains the density information on the seven areas S1 to S7. The read density is obtained as the optical reflectance for the amount of shift a. Meanwhile, as described above, in each area in the fine adjustment pattern, if the amount of shift between the reference pattern BP and the shifted pattern SP is changed, the area ratio of ink to the print medium changes. The density is inversely proportional to the reflectance, and hence, the smaller the amount of shift between the reference pattern BP and the shifted pattern SP printed on a print medium, the lower the density. Hence, the densities of the areas in the fine adjustment pattern illustrated in FIG. 11B are, for example, as illustrated in FIG. 12A. FIG. 12A is a graph showing the optical reflectances of the areas S1 to S7 in the fine adjustment pattern.

In S1010, an approximate curve is calculated from the change in the read density information on the areas S1 to S7. After that, on the basis of the calculated approximate curve, the controller 40 determines the amount of shift a that makes smallest the positional deviation between the reference pattern BP and the shifted pattern SP. This amount of shift a is used as the adjustment value obtained by the first fine adjustment process. Then, the adjustment value applied when the fine adjustment pattern is printed, in other words, the adjustment value obtained by the first rough adjustment process and the adjustment value obtained by the first fine adjustment process (second adjustment value) are added together to calculate a final adjustment value. Note that in the case where the resolutions of the rough adjustment pattern and the fine adjustment pattern are 1200 dpi, the adjustment value is calculated in a resolution of a unit of 1200 dpi or larger. The first fine adjustment process described above is executed by the controller 40. In other words, in the printing apparatus 10, the controller 40 functions as a second obtaining unit that obtains an adjustment value, based on the fine adjustment pattern.

Here, in the case of using ink with a high brightness or in the case where the amount of ink ejection has decreased, if the fine adjustment pattern is printed without increasing the number of dots, the densities of the areas S1 to S7 determined based on the detection of the reflection sensor 86 will not have much difference. Note that the reduction in the amount of ink ejection is caused by ink variation in production, manufacturing tolerances of ejection openings, swelling of ejection openings due to ink, and deterioration of ejection openings over time.

Figure 12B:
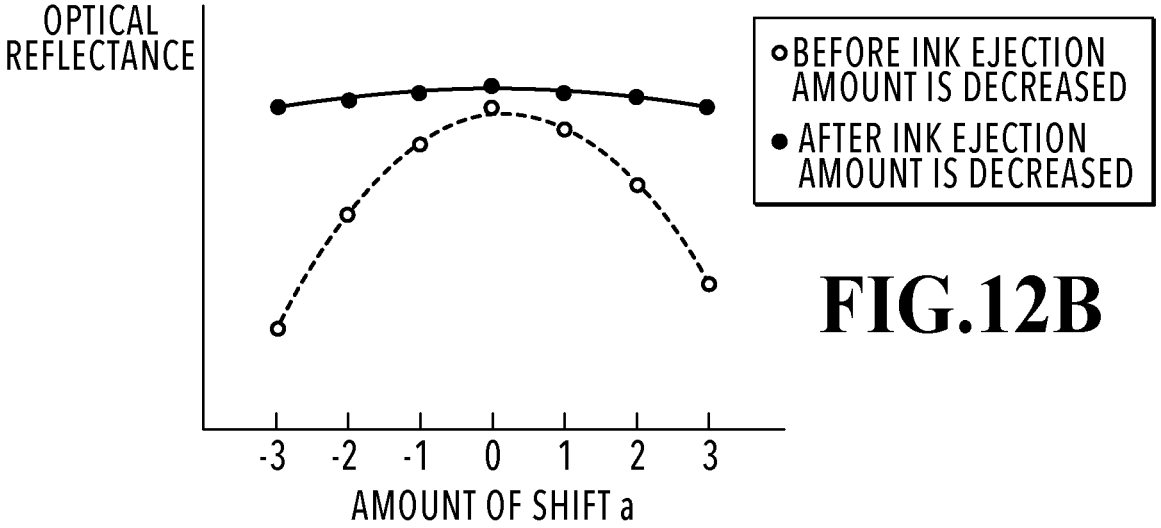

FIG. 12B is a graph showing the difference in optical reflectance between the case where the amount of ink ejection has decreased and the case where it has not. For example, in the case where the amount of ink ejection has decreased (see the black dots in FIG. 12B), the optical reflectances are higher in whole than in the case where the amount of ink ejection has not decreased (see the hollow circles in FIG. 12B). This symptom is more noticeable at high density portions. Accordingly, the difference in density between the areas is too small in the approximate curve calculated from the change in optical reflectance of the areas S1 to S7 in the fine adjustment pattern, so that the influence of reading errors of the reflection sensor 86, height changes in the measurement system, the smoothness of the print medium, and other factors increases. This can make it impossible to obtain with high accuracy the amount of shift a that makes the positional deviation between the reference pattern BP and the shifted pattern SP smallest. This can also make it impossible to determine the amount of shift a based on the area at which the positional deviation between the reference pattern BP and the shifted pattern SP is smallest because the difference in density is small.

For this reason, in this first fine adjustment process, in the case where the insufficient-density flag is on, in other words, in the case where the density of the rough adjustment pattern is lower than a predetermined density, the fine adjustment pattern is printed with an increased number of dots in S1006. In other words, the number of dots is increased to print the fine adjustment pattern in a higher density, and this makes noticeable the difference in density between the areas S1 to S7, detected by the reflection sensor 86. This operation makes it less likely that the approximate curve calculated from the change in optical reflectance obtained from the densities of the areas is affected by reading errors or the like, making it possible to obtain the amount of shift a accurately.

Figure 12C:
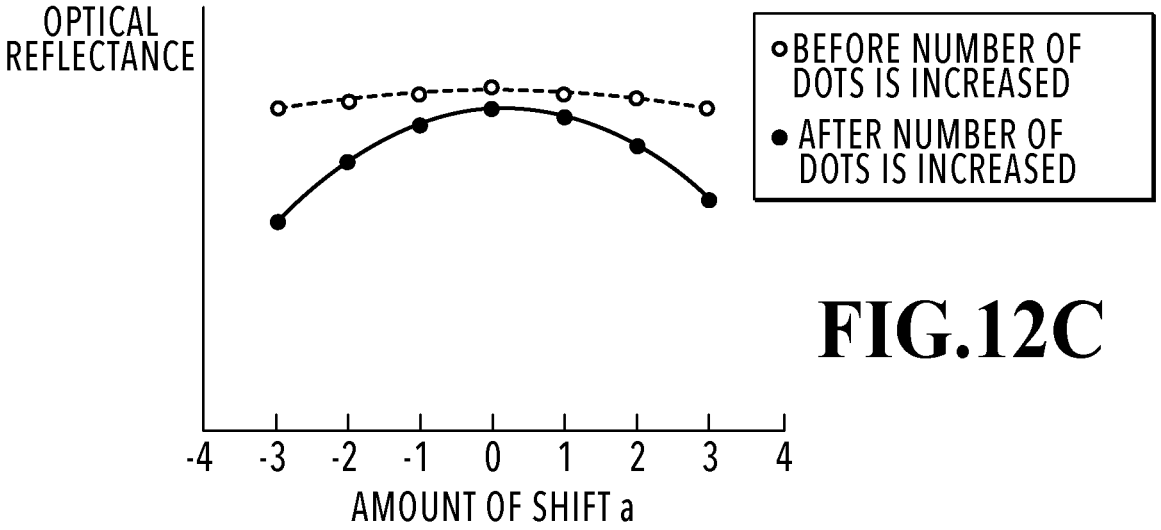

FIG. 12C is a graph showing the difference in optical reflectance between the case where the fine adjustment pattern is printed with a set number of dots and the case where the fine adjustment pattern is printed using twice as many dots as the set number of dots, for the case where ink with high brightness is used. For the ink with high brightness, the difference in density between the areas is small as the hollow circles indicate in FIG. 12C. In contrast, as the black dots indicate in FIG. 12C, doubling the number of dots makes the difference in density between the areas noticeable, making it possible to obtain the amount of shift a accurately.

Thus, in the first fine adjustment process, in the case where the insufficient-density flag is on, the fine adjustment pattern is printed in a high density to make the difference in density between the areas in the fine adjustment pattern noticeable. Hence, the predetermined density which is the threshold for the density information on the patches in the rough adjustment pattern and is used in the first rough adjustment process in S714 is the lowest value that makes it possible to obtain the difference in density that is not affected very much by the influence of reading errors or the like of the reflection sensor 86 and that does not make it difficult to determines the amount of shift a. Note that S714 is a process for determining whether to set the insufficient-density flag on.

Returning to FIG. 6, after the first fine adjustment process finishes, the process proceeds to S608, and the adjustment value obtained in the first fine adjustment process is stored, for example, in the storing unit of the controller 40, and the first registration process ends. Note that in print operation based on print jobs after the first registration process, printing to which the stored adjustment value is applied is performed on print media.

In the first registration process, as has been described above, after the rough adjustment process in a distance detection method is performed, the fine adjustment process in a density method is performed. In the rough adjustment process, the on/off of the insufficient-density flag is set based on the density of the patches determined when the rough adjustment pattern is read. After that, in the fine adjustment process, in the case where the insufficient-density flag is off, the fine adjustment pattern is printed in a density set in advance, and in the case where the insufficient-density flag is on, the fine adjustment pattern is printed in a density higher than the density set in advance. This makes it possible to obtain the adjustment value reliably based on the density information on the fine adjustment pattern even in the case where ink with high brightness is used or in the case where the amount of ink ejection has decreased. Thus, in the printing apparatus 10, the positional deviations in the landing positions of ejected ink droplets can be adjusted exactly. In addition, since the density is increased only for the inks for which doing so is necessary, it is possible to reduce the time required for the registration process and the amount of ink consumed for the process.

Second Embodiment

Figure 14:
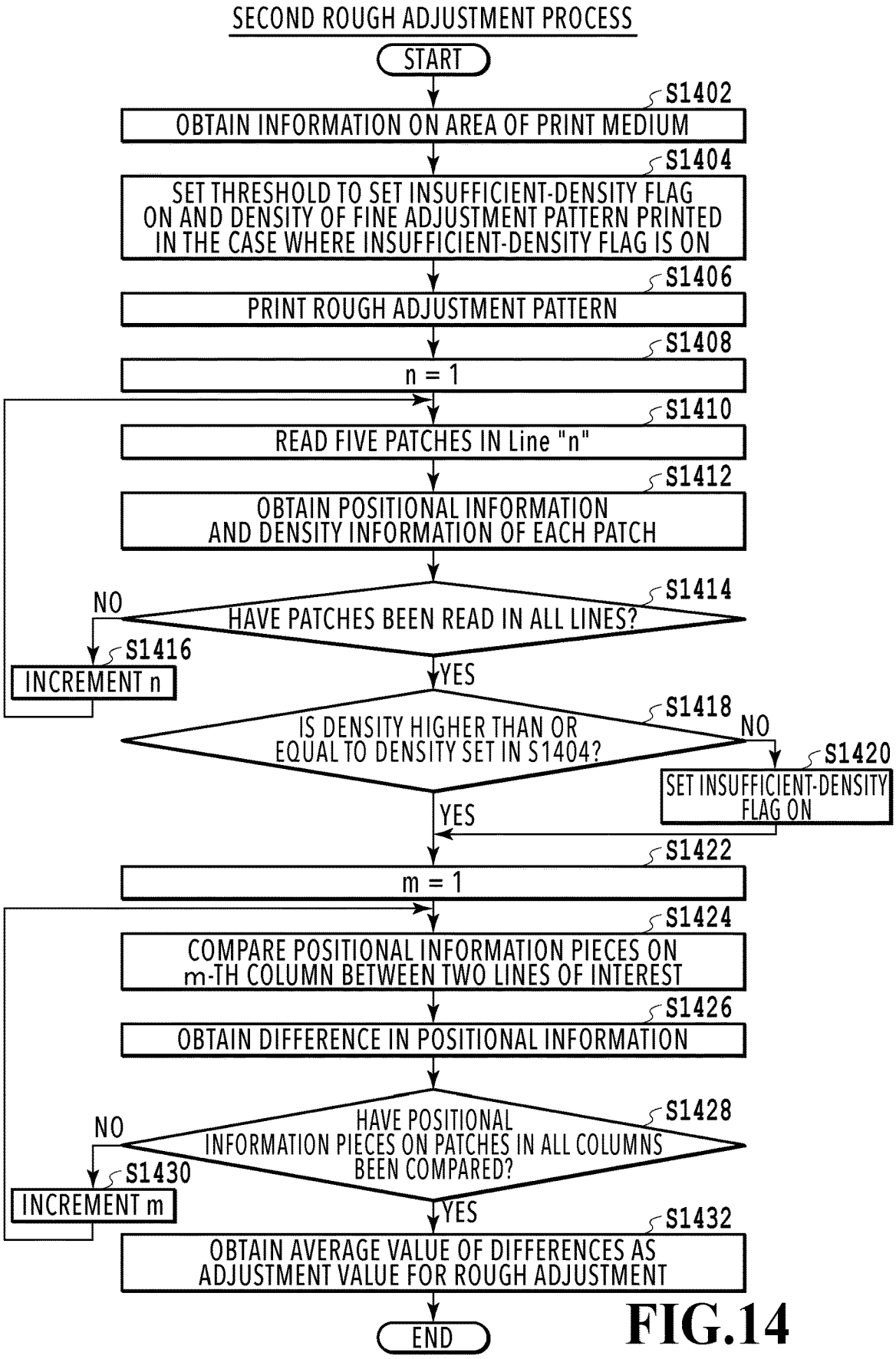
FIG. 14 is a flowchart illustrating process details of a second rough adjustment process.
Figure 15:
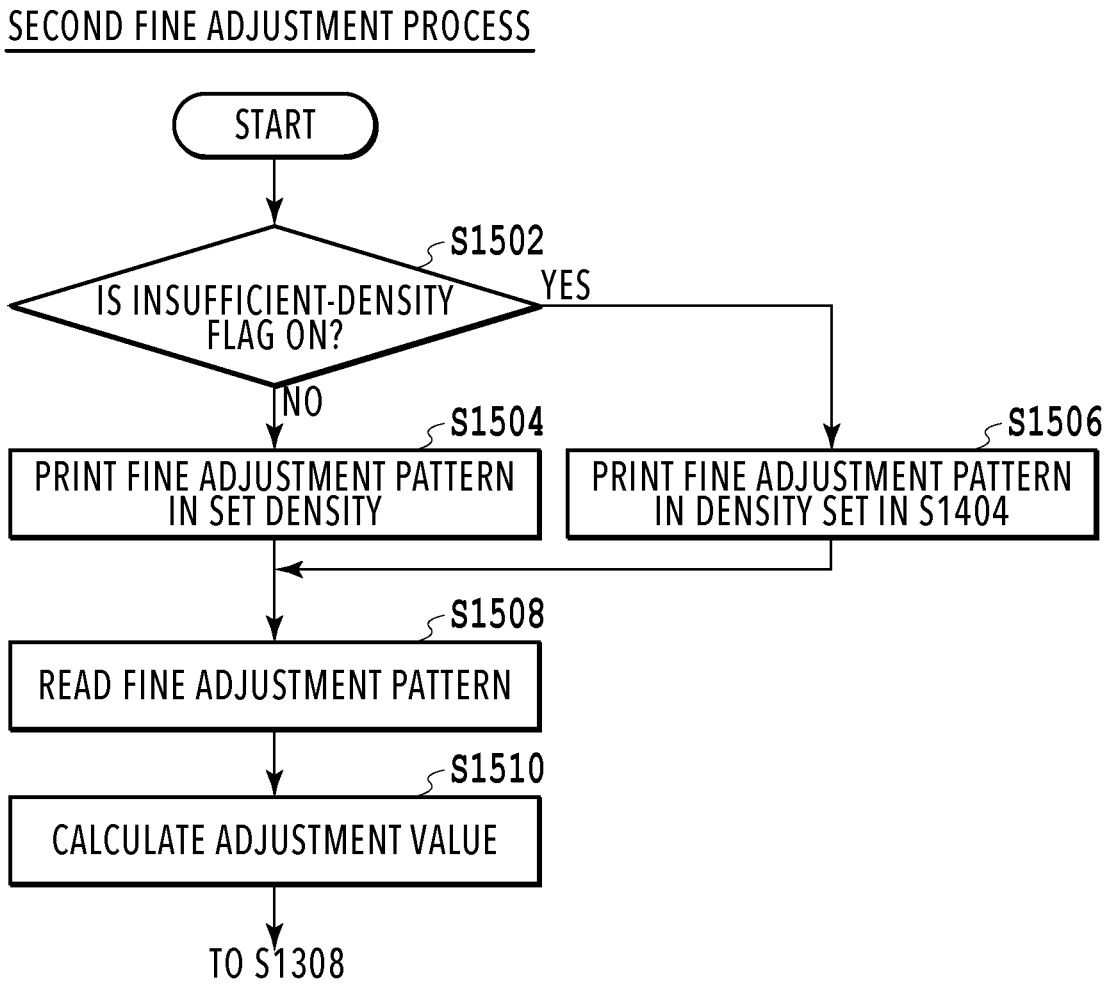
FIG. 15 is a flowchart illustrating process details of a second fine adjustment process.

Next, a second embodiment of a printing apparatus according to the present invention will be described with reference to FIGS. 13 to 15. Note that in the following description, the constituents the same as or corresponding to those in the printing apparatus according to the above first embodiment are denoted by the same reference numerals, and detailed description thereof is omitted as appropriate.

The printing apparatus according to this second embodiment is different from the printing apparatus according to the above first embodiment in that the threshold to set the insufficient-density flag on and the density in which the fine adjustment pattern is printed are set depending on the type of print medium to be used.

The printing apparatus 10 is capable of performing printing on various types of print media, and the user can print on a print medium suitable for the purpose. In this case, the registration process is performed using the print medium to be used, and the suitable amount of ink to be applied is different depending on the type of print medium. For this reason, in the case where the insufficient-density flag is on in the fine adjustment process, if the fine adjustment pattern is printed using dots the number of which was increased at the same rate without considering the type of print medium, the amount of ink applied to the print medium may exceed the appropriate amount (the appropriate range). In a print medium to which ink was applied in an amount exceeding the appropriate amount, cockling which causes ripples of the print medium occurs. In the case where cockling has occurred in a print medium, the distance between the print medium and the nozzle surface of the print heads 34 changes, causing positional deviation in the printing position. In addition, in the case where the degree of cockling is high, the print medium in which cockling has occurred can come in contact with the nozzle surface, causing damage to nozzles.

Hence, in the present embodiment, in the case where the insufficient-density flag is on, the density in which the fine adjustment pattern is printed is set according to the type of print medium. Specifically, the density in which the fine adjustment pattern is printed for the case where the insufficient-density flag is on is set to a density that increases the difference in density between the areas in the fine adjustment pattern but that will not cause cockling in the print medium for use.

Even if the amount of applied ink is the same, the density that appears can be different depending on the type of print medium. For this reason, the threshold to set the insufficient-density flag on is set according to the type of print medium in the second embodiment.

Specifically, in the registration process in the present embodiment, the controller 40 sets the threshold to set the insufficient-density flag on and the density of the fine adjustment pattern printed in the case where the insufficient-density flag is on, based on information on the type of print medium. The information on the type of print medium is, for example, inputted by the user via the host apparatus 58 or the like connected to the printing apparatus 10 via the operation unit 24 or the I/F 60 provided in the printing apparatus 10. The inputted information is, for example, stored in the storing unit (not illustrated) in the controller 40. In the printing apparatus 10, the host apparatus 58 and the operation unit 24 function as an input unit through which various kinds of information can be inputted.

Registration Process

Figure 13:
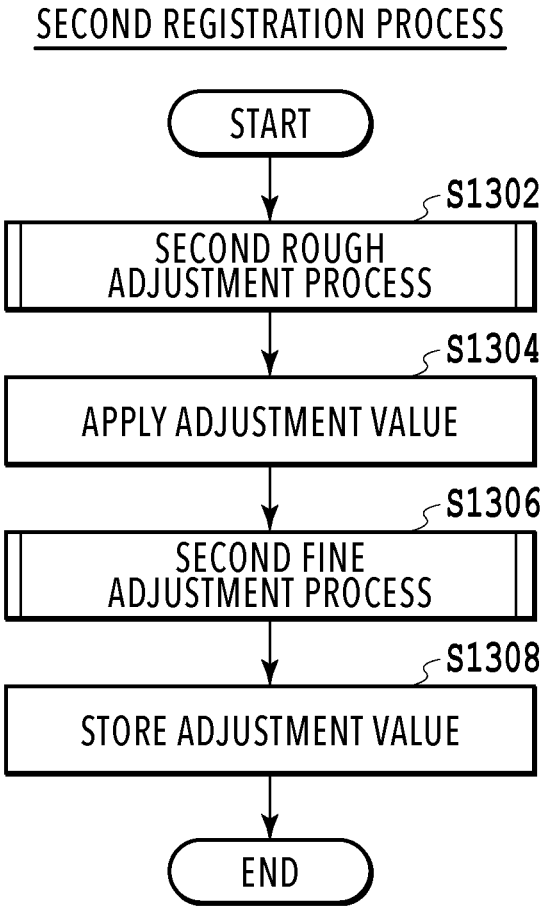
FIG. 13 is a flowchart illustrating process details of a second registration process.

FIG. 13 is a flowchart illustrating process details of a second registration process performed in a printing apparatus according to the second embodiment. FIG. 14 is a flowchart illustrating process details of a second rough adjustment process in the second registration process. FIG. 15 is a flowchart illustrating process details of a second fine adjustment process in the second registration process.

In the second registration process, a rough adjustment process is performed in a distance detection method, and then, a fine adjustment process is performed in a density method in the state where the adjustment value obtained in the rough adjustment process is applied, in the same way as in the above first registration process. Note that a series of processes illustrated in the flowcharts of the second registration process in FIG. 13, the second rough adjustment process in FIG. 14, and the second fine adjustment process in FIG. 15 is executed by the MPU 42 loading programs stored in the ROM 44 into the RAM 48. Alternatively, part or all of the functions of the steps in each flow chart may be implemented using hardware such as an ASIC or an electronic circuit.

When the user gives the instruction to start the registration process, for example, via the host apparatus 58, the printing apparatus 10 starts the second registration process illustrated in FIG. 13. When the second registration process starts, first, the second rough adjustment process is performed (S1302). In the second rough adjustment process, first, the information on the type of print medium is obtained as illustrated in FIG. 14 (S1402). Specifically, in S1402, the information on the type of print medium inputted by the user and stored in the storing unit of the controller 40 is obtained. Note that in the case where the information on the type of print medium is not able to be obtained, in other words, in the case where the information on the type of print medium is not stored in the storing unit, or in other cases, may be made to prompt the user to input the information on the type of print medium. In S1402, the insufficient-density flag is initialized to set it off.

Next, the threshold to set the insufficient-density flag on and the density of the fine adjustment pattern printed in the case where the insufficient-density flag is on are set based on the information on the type of print medium (S1404). Note that the threshold to set the insufficient-density flag on is determined by referring to a table in which values for the threshold are associated with the types of print media. The density of the fine adjustment pattern printed in the case the insufficient-density flag is on is determined by referring to a table in which values for the density are associated with the types of print media. Note that the thresholds and densities associated with the types of print media are determined experimentally. These tables are stored, for example, in the ROM 44. These threshold and density settings are executed by the controller 40. In other words, in the printing apparatus 10, the controller 40 functions as a setting unit that sets the threshold to set the insufficient-density flag on and the density of the fine adjustment pattern printed in the case the insufficient-density flag is on.

After that, the rough adjustment pattern is printed (S1406), and n is set to 1 (S1408). Then, the patches in Line "n" in the rough adjustment pattern is read (S1410), and the positional information and density information on the patches are obtained (S1412). Next, it is determined whether the patches in all the lines in the rough adjustment pattern have been read (S1414). If it is determined that the patches in all the lines have not read, n is incremented (S1416), and the process returns to S1410. Note that the concrete process details in S1406 to S1416 are the same as those in S704 to S712 in the above first rough adjustment process, and description thereof is omitted.

If it is determined in S1414 that the patches in all the lines have been read, it is determined whether the density of the patches is higher than or equal to the threshold set in S1404 (S1418). In S1418, in the case where the densities of all the patches are higher than or equal to the threshold set in S1404, it is determined that the density of the patches is higher than or equal to the threshold, and in the other cases, it is determined that the density of the patches is lower than the threshold. If it is determined in S1418 that the density of the patches is lower than the threshold, the insufficient-density flag is set on (S1420), and the process proceeds to S1422. On the other hand, if it is determined in S1418 that the density of the patches is higher than or equal to the threshold, the process proceeds to S1422 with the insufficient-density flag kept off. In S1422, m is set to 1, and comparison is made between positional information pieces on the patches in the m-th column in two lines of interest (S1424).

Next, the difference between the two positional information pieces on the patches in the m-th column in the two lines is obtained (S1426), and then, it is determined whether the patches in all the columns have been compared (S1428). If it is determined in S1428 that the patches in all the columns have not been compared, m is incremented (S1430), and the process returns to S1424. On the other hand, if it is determined in S1428 that all the patches in all the columns have been compared, the average value of the differences in all the columns obtained in S1426 is obtained as the adjustment value in the second rough adjustment process (S1432), and the process proceeds to S1304. Note that the concrete process details in S1420 to S1432 are the same as those in S716 to S728 in the above first rough adjustment process, and description thereof is omitted.

Returning to FIG. 13, after the second rough adjustment process finishes, the process proceeds to S1304, and the adjustment value obtained in the second rough adjustment process is applied to the printing apparatus 10. Note that the concrete process details in S1304 are the same as those in S604 in the above first registration process, and description thereof is omitted. After that, the second fine adjustment process is performed in the state where the adjustment value obtained in the second rough adjustment process is applied (S1306). In the second fine adjustment process, it is first determined whether the insufficient-density flag is on, as illustrated in FIG. 15 (S1502). If it is determined in S1502 that the insufficient-density flag is off, a fine adjustment pattern is printed in a density set in advance (S1504), and the process proceeds to S1508. In S1504, the fine adjustment pattern is printed using dots the number of which is set in advance. On the other hand, if it is determined in S1502 that the insufficient-density flag is on, the fine adjustment pattern is printed in the density set in S1404 (S1506), and the process proceeds to S1508. In S1506, the fine adjustment pattern is printed with an increased number of dots based on the density set in S1404. Note that the fine adjustment pattern used for printing is the same as the one used in the above first fine adjustment process.

Next, the printed fine adjustment pattern is read in S1508, an adjustment value is calculated based on the read information (S1510), and the process proceeds to S1308. Note that the concrete process details in S1508 and S1510 are the same as those in S1008 and S1010 in the above first fine adjustment process, and description thereof is omitted.

Returning to FIG. 13, after the second fine adjustment process finishes, the process proceeds to S1308, where the adjustment value obtained in the second fine adjustment process is stored, for example, in the storing unit of the controller 40, and the second registration process ends. Note that in print operation based on print jobs after the second registration process, printing to which the stored adjustment value is applied is performed on print media.

In the second registration process, as has been described above, the threshold to set the insufficient-density flag on and the density in which the fine adjustment pattern is printed for the case the insufficient-density flag is on are set according to the type of print medium. Thus, the insufficient-density flag can be set according to the type of print medium, and this prevents the occurrence of cockling in the print medium even if the fine adjustment pattern is printed in high density. Thus, in the printing apparatus 10, the positional deviations in the landing positions of ejected ink droplets can be adjusted exactly.

Third Embodiment

Next, a third embodiment of a printing apparatus according to the present invention will be described with reference to FIGS. 16 to 18. Note that in the following description, the constituents the same as or corresponding to those in the printing apparatus according to the above first embodiment are denoted by the same reference numerals, and detailed description thereof is omitted as appropriate.

The printing apparatus according to this third embodiment is different from the printing apparatuses according to the above first and second embodiments in that the user determines an adjustment value and inputs it to printing apparatus in the fine adjustment process.

Specifically, in the present embodiment, a fine adjustment pattern for user's determination is printed in the fine adjustment process in the registration process. Then, if the insufficient-density flag is off, the fine adjustment pattern for user's determination is printed in a density set in advance, and if the insufficient-density flag is on, the fine adjustment pattern for user's determination is printed in twice the density set in advance.

Figure 16:
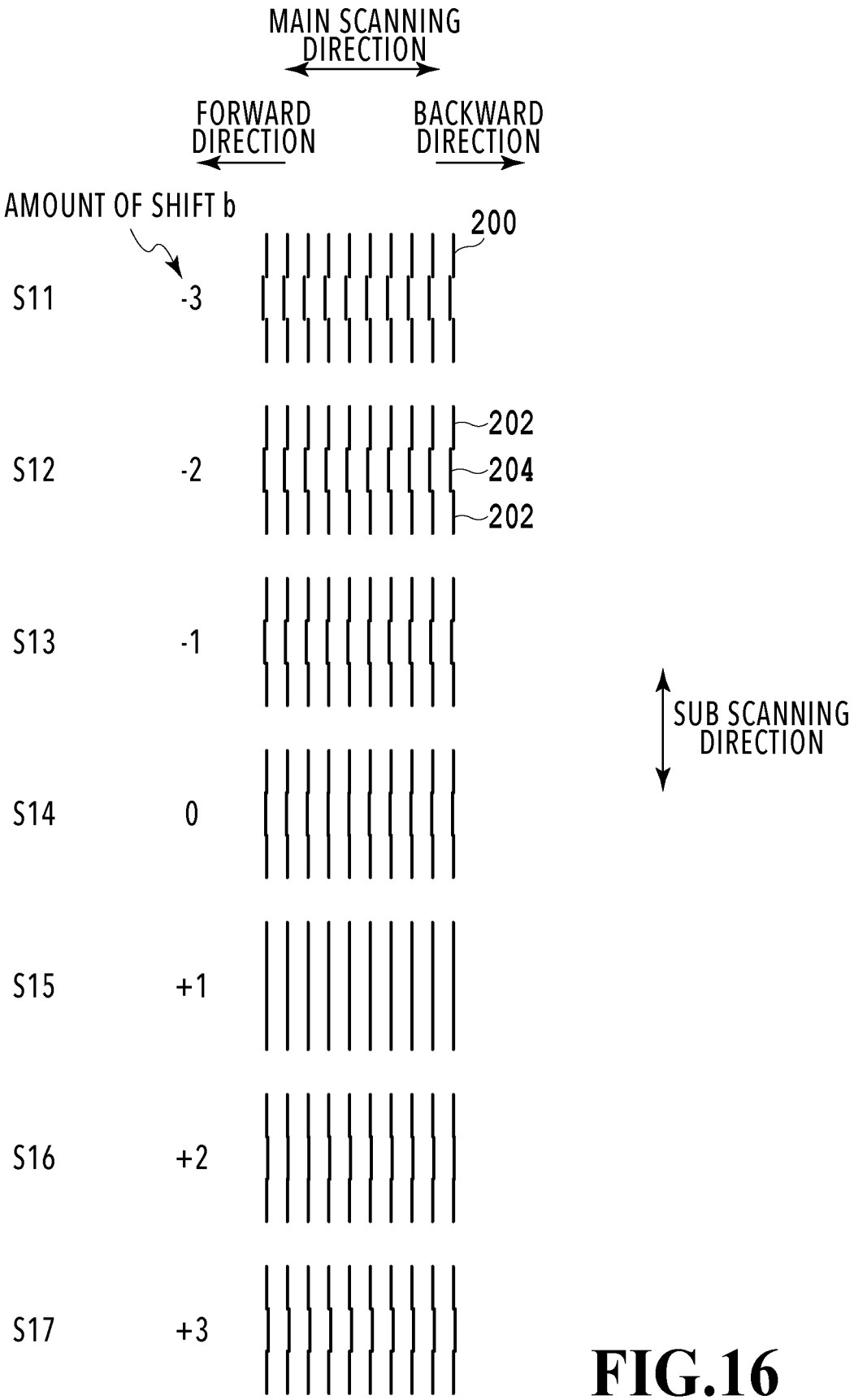
FIG. 16 is a diagram for explaining a fine adjustment pattern for user's determination.

FIG. 16 is a diagram illustrating a fine adjustment pattern for user's determination. The fine adjustment pattern for user's determination is printed such that is has multiple areas S11 to S17 in each of which lines 200 extending in the sub scanning direction are arranged along the main scanning direction. A line 200 has line-shaped reference bars (reference image) 202 extending in the sub scanning direction at both its ends in the sub scanning direction and a line-shaped comparative bar (comparative image) 204 extending in the sub scanning direction at its center, the reference bars and the comparative bar being connected to continue with one another in the sub scanning direction. The reference bars 202 and the comparative bar 204 are printed in different print conditions. Specifically, the reference bars 202 are printed in a reference condition, for example, with a predetermined nozzle row during the movement in the forward direction, and the comparative bar 204 is printed in a condition to be checked, for example, with the predetermined nozzle row during the movement in the backward direction. The fine adjustment pattern for user's determination is printed such that the areas S11 to S17, arranged in the sub scanning direction, each have a different amount of shift b of the comparative bar 204 relative to the reference bars 202, changed in the main scanning direction. For example, FIG. 16 shows a printed fine adjustment pattern for user's determination in which the amount of shift b is changed from −3 pixels to +3 pixels.

The user visually checks the printed fine adjustment pattern for user's determination to find an area in which the reference bars 202 and the comparative bar 204 area aligned. Then, the user inputs the amount of shift b of the area in which the bars are aligned, via the host apparatus 58 or the like. The inputted value is stored in the controller 40 as the adjustment value. For example, in FIG. 16, the reference bars 202 and the comparative bar 204 are aligned in the area in which the amount of shift b is "+1". In this case, it indicates that ink should be ejected at a later timing by the time corresponding to one pixel in printing in the backward direction. Note that although the amount of shift b in the present embodiment is in the range of ±3 for easy understanding, the amount of shift b is set to have a range sufficient for adjustment based on the variation of ink ejection speed and other factors.

Registration Process

Figure 17:
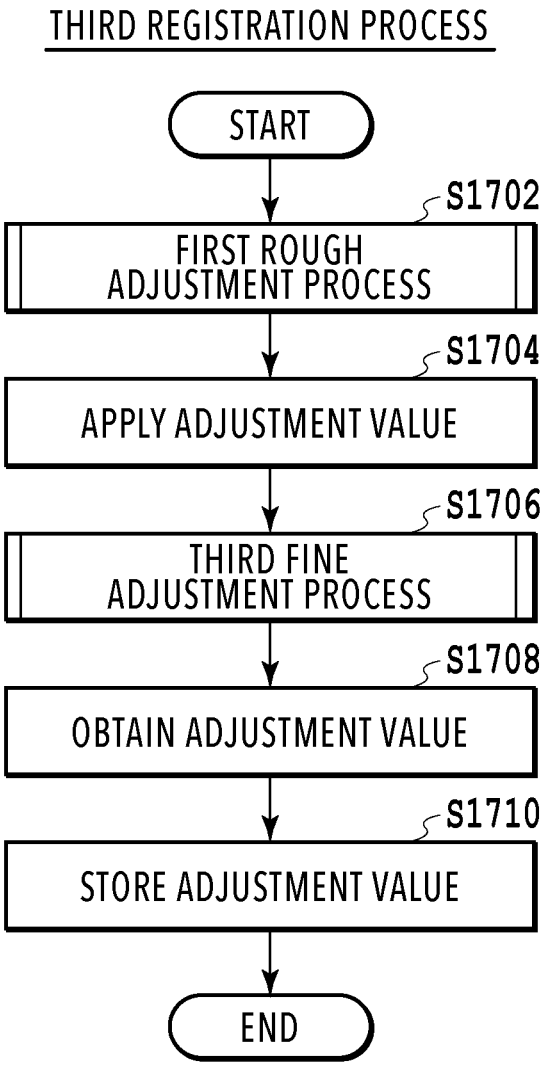
FIG. 17 is a flowchart illustrating process details of a third registration process.
Figure 18:
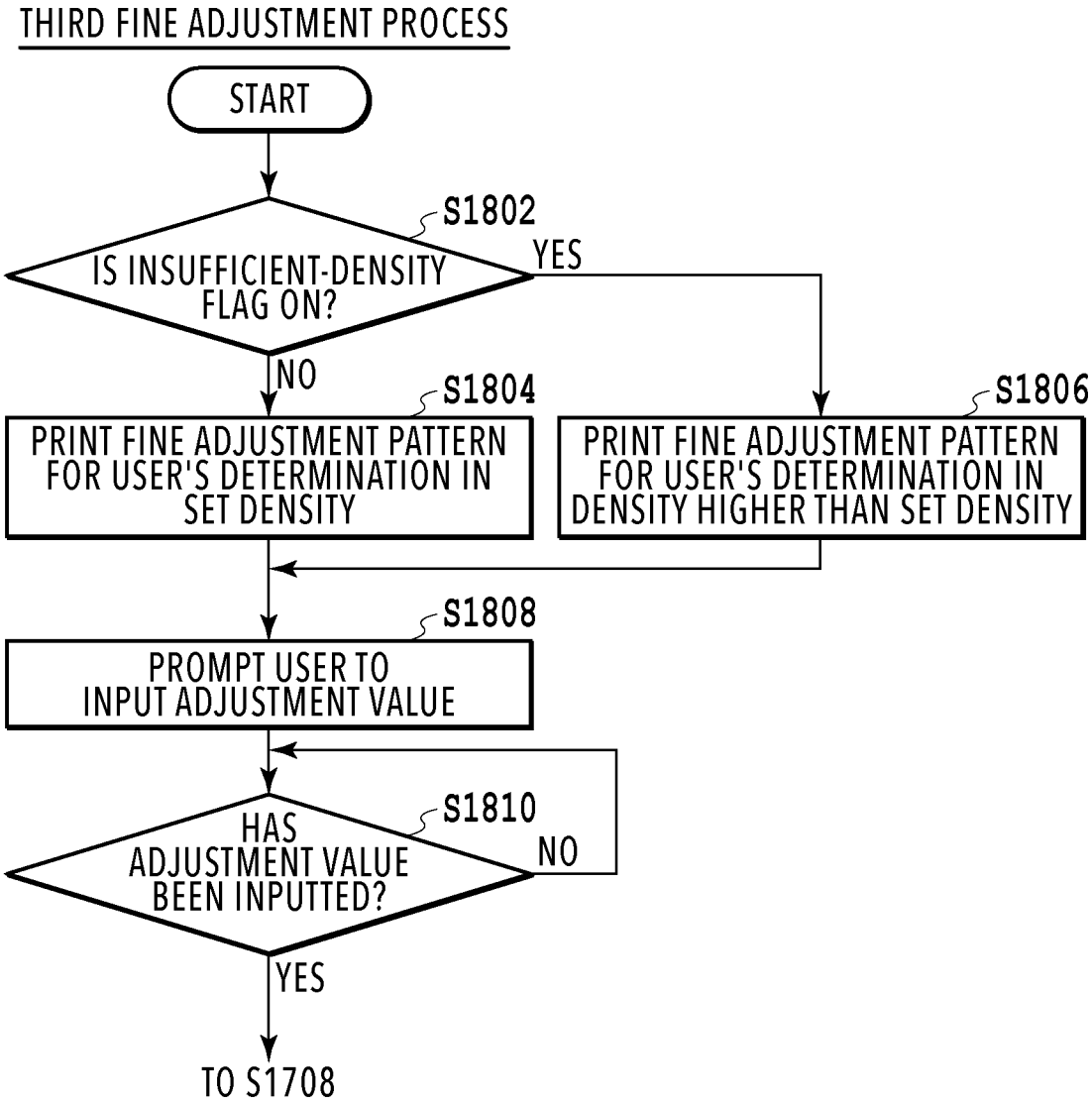
FIG. 18 is a flowchart illustrating process details of a third fine adjustment process.

FIG. 17 is a flowchart illustrating process details of a third registration process performed in a printing apparatus according to the third embodiment. FIG. 18 is a flowchart illustrating process details of a third fine adjustment process in the third registration process. Note that a series of processes illustrated in the flowcharts of the third registration process in FIG. 17 and the third fine adjustment process in FIG. 18 is executed by the MPU 42 loading programs stored in the ROM 44 into the RAM 48. Alternatively, part or all of the functions of the steps in each flow chart may be implemented using hardware such as an ASIC or an electronic circuit.

When the user gives the instruction to start the registration process, for example, via the host apparatus 58, the printing apparatus 10 starts the third registration process illustrated in FIG. 17. In the third registration, the first rough adjustment process is first performed (S1702), and then, the adjustment value obtained in the first rough adjustment process is applied to the printing apparatus 10 (S1704). Concrete process details in S1702 and S1704 are the same as those in S602 and S604 in the above first registration process, and description thereof is omitted.

Next, the third fine adjustment process is performed (S1706). In the third fine adjustment process, it is determined whether the insufficient-density flag is on, as illustrated in FIG. 18 (S1802). If it is determined in S1802 that the insufficient-density flag is off, a fine adjustment pattern for user's determination is printed in a density set in advance (S1804), and the process proceeds to S1808. If it is determined in S1802 that the insufficient-density flag is on, the fine adjustment pattern for user's determination is printed in a density higher than the density set in advance (S1806), and the process proceeds to S1808. In other words, in S1804, the fine adjustment pattern for user's determination is printed using dots the number of which is set in advance. In S1806, the fine adjustment pattern for user's determination is printed using twice as many dots as the number of dots set in advance.

After that, in S1808, notification is made to prompt the user to input an adjustment value based on the fine adjustment pattern for user's determination, and then it is determined whether the adjustment value has been inputted (S1810). In summary, in the present embodiment, the user checks a printed fine adjustment pattern, the user determines an adjustment value based on the adjustment pattern, and the user inputs the adjustment value. In S1810, if it is determined that an adjustment value has been inputted, the process proceeds to S1708.

Returning to FIG. 17, after the third fine adjustment process finishes, the process proceeds to S1708, where a final adjustment value is obtained based on the adjustment value obtained in the third fine adjustment process, in other words, the adjustment value that is the result of the user input, and the adjustment value obtained in the first rough adjustment process. Then, the adjustment value thus obtained is stored, for example, in the storing unit of the controller 40 (S1710), and the third registration process ends. In print operation based on print jobs after the third registration process, printing to which the stored adjustment value is applied is performed on print media.

The third registration process, as has been described above, the adjustment value in the fine adjustment process is obtained based on the user's determination. This makes it possible to provide the same effect as in the first registration process. Since the pattern in each area is line-shaped in the fine adjustment pattern for user's determination, the amount of applied ink per a unit area in the fine adjustment pattern is smaller in this embodiment than in the first embodiment. Hence, for the print medium in which cockling easily occurs, use of the fine adjustment pattern for user's determination prevents the occurrence of cockling more positively.

Other Embodiments

Note that the above embodiments may be modified as shown in the following (1) to (6).

(1) In the above first embodiment and third embodiment, the increase in the number of dots is not limited to two times as long as it increases the difference in density between the areas in a fine adjustment pattern when the fine adjustment pattern is printed in high density. In addition, although in the above third embodiment, the fine adjustment process is performed after the rough adjustment process is performed, in the third registration process, the present disclosure is not limited to this operation. Specifically, the fine adjustment process may be performed based on the on/off state of the insufficient-density flag in the last registration process.

(2) Although this was not specifically stated in the above embodiments, the configuration and the number of nozzle arrays, chips, and print heads 34, and further, the colors and the types of ink are mere examples, and hence, they may be modified as appropriate. Although in the above embodiments, the printing apparatus 10 has been described assuming that it is an inkjet printing apparatus, as an example, but the printing apparatus 10 is not limited to this type. Specifically, the printing apparatus 10 may use any print method as long as it has a configuration in which printing is performed by forming dots while the print head and the print medium are being relatively moved.

(3) Although this was not specifically stated in the above embodiments, the printing apparatus 10 may have a configuration that is capable of performing at least two registration processes of the first to three registration processes and that allows the user to select a registration process to be performed. For example, the printing apparatus 10 is configured such that it is capable of selectively performing the first registration process (first process) and the third registration process (second process). In this case, the printing apparatus 10 may notify the user of a recommended registration process. Specifically, for example, the types of print media for which the third registration process is recommended are stored in advance, and if the print medium to be used is a stored print medium, the printing apparatus 10 may notify the user of the third registration process. For example, if it is a print medium for which the occurrence of cockling should be prevented positively, the printing apparatus 10 recommends the third registration process. The user is notified of the recommended registration process, for example, via the host apparatus 58 or the operation unit 24, and then, the user selects a registration process to perform, through the host apparatus 58, the operation unit 24, or the like. In this case, the controller 40 determines the registration process to recommend, and the determined registration process is displayed on the host apparatus 58 or the operation unit 24. Hence, in this case, the controller 40, the host apparatus 58, the operation unit 24, and the like function as a notification unit.

(4) Although this was not specifically stated in the above embodiments, in the case where ink to be used has high brightness, a fine adjustment pattern with high density may be printed unconditionally. In addition, although in the registration process in the above embodiment, the fine adjustment process is performed after the rough adjustment process, the present disclosure is not limited to this operation. Specifically, in the registration process, only the fine adjustment process may be performed without performing the rough adjustment process. In this case, in the case where an adjustment value was not able to be obtained in the last fine adjustment process, the fine adjustment pattern in high density may be printed in the fine adjustment process this time. Further, also in the above third embodiment, the threshold to set the insufficient-density flag on and the density of the fine adjustment pattern printed in the case where the insufficient-density flag is on may be set based on the type of print medium, as in the above second embodiment.

(5) Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)TM), a flash memory device, a memory card, and the like.

(6) The above embodiments and various embodiments shown in the above (1) to (5) may be combined as appropriate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-044611, filed Mar. 12, 2019, which is hereby incorporated by reference herein in its entirety.

What is claimed is:

1. printing apparatus comprising:

a print head including a nozzle through which ink is ejected and being configured to print a print image by ejecting ink through the nozzle to form dots on a print medium;

a measurement unit configured to measure an optical characteristic of a print image printed on a print medium;

a movement unit configured to impart relative movement between a print medium and the print head;

a first obtaining unit configured to obtain a first adjustment value, based on a measurement result of the measurement unit measuring a first pattern that is (a) formed on a print medium and (b) composed of a print image printed by a predetermined print operation including the relative movement, the first adjustment value being for adjusting dot printing positions in the predetermined print operation;

a second obtaining unit configured to obtain a second adjustment value, based on a second pattern printed by the predetermined print operation in a state where dot printing positions of the print head have been adjusted using the first adjustment value, the second adjustment value being for adjusting the dot printing positions at a unit of length shorter than a unit of length at which the printing positions are adjusted using the first adjustment value in the predetermined print operation; and a control unit configured to control the print head and the movement unit to make the print head and the movement unit print a print image on a print medium by the predetermined print operation while applying the first adjustment value and the second adjustment value in the control, wherein the control unit controls the print head based on the measurement result of the first pattern measured by the measurement unit such that a number of dots forming the second pattern is changed according to density information of the first pattern measured by the measurement unit.

2. The printing apparatus according to claim 1, wherein the control unit determines whether the density information of the first pattern measured by the measurement unit is higher than or equal to a threshold, and wherein the control unit controls the print head such that (a) in a case where the density information is lower than the threshold, the second pattern is printed with dots the number of which is more than a set number, and (b) in a case where the density information is higher than or equal to the threshold, the second pattern is printed in with the set number of dots.

3. The printing apparatus according to claim 2, further comprising:

an input unit capable of receiving input of information on a type of print medium; and a setting unit configured to set the threshold and the number of dots for forming the second pattern in a case where the density information is higher than or equal to the threshold, based on the information inputted through the input unit.

4. The printing apparatus according to claim 2, wherein in a case where the density information is higher than or equal to the threshold, the control unit prints the second pattern with dots the number of which is twice the set number.

5. The printing apparatus according to claim 2, wherein in a case where the density information is higher than or equal to the threshold, the control unit prints the second pattern by performing a predetermined number of printing scans, and wherein in a case where the density information is lower than the threshold, the control unit prints the second pattern by performing more than the predetermined number of printing scans.

6. The printing apparatus according to claim 1, wherein the second adjustment value has higher adjustment accuracy and a narrower adjustable range than the first adjustment value.

7. The printing apparatus according to claim 1, wherein the second obtaining unit obtains the second adjustment value based on density information of the second pattern measured by the measurement unit.

8. The printing apparatus according to claim 7, wherein the first pattern includes (a) a patch printed during the relative movement in a first direction that is a direction intersecting an arrangement direction in which multiple nozzles for the same color are arrayed in the print head and (b) a patch printed during the relative movement in a second direction that is the direction opposite to the first direction, wherein the patch printed during the relative movement in the first direction and the patch printed during the relative movement in the second direction are arranged at an interval in a direction intersecting a relative movement direction of the relative movement of the print head relative to a print medium, wherein the second pattern includes multiple areas in each of which multiple patches at predetermined intervals in the relative movement direction are printed during the relative movement in the first direction, wherein multiple patches at predetermined intervals in the relative movement direction are printed during the relative movement in the second direction, wherein the patches printed during the relative movement in the second direction are shifted to the relative movement direction from the patches printed during the relative movement in the first direction, wherein the patches printed during the relative movement in the second direction are overlapped with the patches printed during the relative movement in the first direction, and wherein the amount of shift of the patches printed during the relative movement in the second direction is different in each of the multiple areas.

9. The printing apparatus according to claim 8, wherein the first obtaining unit obtains the first adjustment value based on distance information on the distance in the relative movement direction between (a) the patches printed during the relative movement in the first direction and (b) the patches printed during the relative movement in the second direction, and wherein the second obtaining unit obtains the second adjustment value based on density information of the areas.

10. The printing apparatus according to claim 7, wherein the first pattern includes (a) a patch printed by a first nozzle array of multiple nozzle arrays each having multiple nozzles for the same color arrayed in the print head and a patch printed by a second nozzle array of the multiple nozzle arrays, wherein the patch printed by the first nozzle array and the patch printed by the second nozzle array are arranged at an interval in a direction intersecting a relative movement direction of the relative movement of the print head relative to a print medium, wherein the second pattern includes multiple areas in each of which multiple patches at predetermined intervals in the relative movement direction are printed by the first nozzle array, wherein multiple patches at predetermined intervals in the relative movement direction are printed by the second nozzle array, wherein the patches printed by the second nozzle array are shifted to the relative movement direction from the patches printed by the first nozzle array, wherein the patches printed by the second nozzle array are overlapped with the patches printed by the first nozzle array, and wherein the amount of shift of the patches printed by the second nozzle array is different in each of the multiple areas.

11. The printing apparatus according to claim 7, wherein the first pattern includes (a) a patch printed by a first row of a nozzle array having multiple rows each having multiple nozzles for the same color arrayed in the print head and (b) a patch printed by a second row of the nozzle array, wherein the patch printed by the first row and the patch printed by the second row are arranged at an interval in a direction intersecting a relative movement direction of the relative movement of the print head relative to a print medium, wherein the second pattern includes multiple areas in each of which multiple patches at predetermined intervals in the relative movement direction are printed by the first row, wherein multiple patches at predetermined intervals in the relative movement direction are printed by the second row, wherein the patches printed by the second row are shifted to the relative movement direction from the patches printed by the first row, wherein the patches printed by the second row are overlapped with the patches printed by the first row, and wherein the amount of shift of the patches printed by the second row is different in each of the multiple areas.

12. The printing apparatus according to claim 1, further comprising an input unit capable of receiving input of information, wherein the second obtaining unit obtains the second adjustment value based on an input result inputted through the input unit by a user who checked the second pattern.

13. The printing apparatus according to claim 12, further comprising a setting unit configured to set, based on information on a print medium inputted through the input unit, (a) a threshold to be compared with the density information of the first pattern and (b) the number of dots for forming the second pattern.

14. The printing apparatus according to claim 12, wherein the first pattern includes (a) a patch printed during the relative movement in a first direction that is a direction intersecting an arrangement direction in which multiple nozzles for the same color are arrayed in the print head and (b) a patch printed during the relative movement in a second direction that is the direction opposite to the first direction, wherein the patch printed during the relative movement in the first direction and the patch printed during the relative movement in the second direction are arranged at an interval in a direction intersecting a relative movement direction of the relative movement of the print head relative to a print medium, wherein the second pattern includes multiple areas in each of which a reference image in a line shape extending in a direction intersecting the relative movement direction is printed during the relative movement in the first direction wherein a comparative image in a line shape extending in the direction intersecting the relative movement direction is printed during the relative movement in the second direction, wherein the comparative image is shifted to the relative movement direction from the reference image, wherein the comparative image continues to the reference image in the direction intersecting the relative movement direction, and wherein the amount of shift of the comparative image printed during the relative movement in the second direction is different in each of the multiple areas.

15. The printing apparatus according to claim 14, wherein the first obtaining unit obtains the first adjustment value based on distance information on the distance between (a) the patch printed during the relative movement in the first direction and (b) the patch printed during the relative movement in the second direction, and wherein the second obtaining unit obtains the second adjustment value based on information inputted based on the amount of shift of the comparative image relative to the reference image.

16. The printing apparatus according to claim 12, wherein the first pattern includes (a) patch printed by a first nozzle array of multiple nozzle arrays each having multiple nozzles for the same color arrayed in the print head and (b) a patch printed by a second nozzle array of the multiple nozzle arrays, wherein the patch printed by the first nozzle array and the patch printed by the second nozzle array are arranged at an interval in a direction intersecting a relative movement direction of the relative movement of the print head relative to a print medium, wherein the second pattern includes multiple areas in each of which a reference image in a line shape extending in a direction intersecting the relative movement direction is printed by the first nozzle array, wherein a comparative image in a line shape extending in the direction intersecting the relative movement direction is printed by the second nozzle array, wherein the comparative image is shifted to the relative movement direction from the reference image, wherein the comparative image continues to the reference image in the direction intersecting the relative movement direction, and wherein the amount of shift of the comparative image printed by the second nozzle array is different in each of the multiple areas.

17. The printing apparatus according to claim 12, wherein the first pattern includes (a) a patch printed by a first row of a nozzle array having multiple rows each having multiple nozzles for the same color arrayed in the print head and (b) a patch printed by a second row of the nozzle array, wherein the patch printed by the first row and the patch printed by the second row are arranged at an interval in a direction intersecting a relative movement direction of the relative movement of the print head relative to a print medium, wherein the second pattern includes multiple areas in each of which a reference image in a line shape extending in a direction intersecting the relative movement direction is printed by the first row, wherein a comparative image in a line shape extending in the direction intersecting the relative movement direction is printed by the second row, wherein the comparative image is shifted to the relative movement direction from the reference image, wherein the comparative image continues to the reference image in the direction intersecting the relative movement direction, and wherein the amount of shift of the comparative image printed by the second row is different in each of the multiple areas.

18. The printing apparatus according to claim 1, further comprising an input unit capable of receiving input of information, wherein the second obtaining unit is capable of selectively performing (a) a first process to obtain the second adjustment value based on a measurement result of the second pattern measured by the measurement unit and (b) a second process to obtain the second adjustment value based on an input result inputted based on the second pattern.

19. The printing apparatus according to claim 18, further comprising a notification unit configured to make notification recommending one of the first process and the second process, based on information on a type of print medium inputted through the input unit.

20. A registration adjustment method comprising:

a first print step of printing a first pattern by a predetermined print operation including relative movement of a print head that performs printing by ejecting ink through a nozzle to form dots on a print medium;

a first measurement step of measuring the first pattern using a measurement unit capable of measuring an optical characteristic of a print image;

a first obtaining step of obtaining a first adjustment value for adjusting dot printing positions in the predetermined print operation, based on a first measurement result in the first measurement step;

a second print step of printing a second pattern having a configuration different from the first pattern, by the predetermined print operation in a state where dot printing positions of the print head have been adjusted using the first adjustment value;

a second obtaining step of obtaining, based on the second pattern, a second adjustment value for adjusting the dot printing positions at a unit of length shorter than a unit of length at which the printing positions are adjusted using the first adjustment value in the predetermined print operation; and a registration adjustment step of adjusting the dot printing positions in the predetermined print operation, based on the first adjustment value and the second adjustment value, wherein in the second print step, the second pattern is printed with a number of dots that is changed based on density information of the first pattern, based on a measurement result of the first pattern measured in the first measurement step.

21. A non-transitory computer-readable storage medium storing a program for causing a computer to perform a registration adjustment method, the method comprising:

a first print step of printing a first pattern by a predetermined print operation including relative movement of a print head that performs printing by ejecting ink through a nozzle to form dots on a print medium;

a first measurement step of measuring the first pattern, using a measurement unit capable of measuring an optical characteristic of a print image;

a first obtaining step of obtaining a first adjustment value for adjusting dot printing positions in the predetermined print operation, based on a first measurement result in the first measurement step;

a second print step of printing a second pattern having a configuration different from the first pattern, by performing the predetermined print operation in a state where dot printing positions of the print head have been adjusted using the first adjustment value;

a second obtaining step of obtaining, based on the second pattern, a second adjustment value for adjusting the dot printing positions at a unit of length shorter than a unit of length at which the printing positions are adjusted using the first adjustment value in the predetermined print operation; and a registration adjustment step of adjusting the dot printing positions in the predetermined print operation, based on the first adjustment value and the second adjustment value, wherein in the second print step, the second pattern is printed with a number of dots that is changed based on density information of the first pattern, based on a measurement result of the first pattern measured in the first measurement step.

22. A printing apparatus comprising:

a print head including a nozzle through which ink is ejected and configured to print a print image by ejecting ink through the nozzle to form dots on a print medium;

a measurement unit configured to measure an optical characteristic of a print image printed on a print medium;

a movement unit configured to impart relative movement between a print medium and the print head;

a first obtaining unit configured to obtain a first adjustment value, based on a measurement result of the measurement unit measuring a first pattern that is (a) formed on a print medium and (b) composed of a print image printed by a predetermined print operation including the relative movement, the first adjustment value being for adjusting dot printing positions in the predetermined print operation;

a second obtaining unit configured to obtain a second adjustment value, based on a second pattern printed by the predetermined print operation in a state where dot printing positions of the print head have been adjusted using the first adjustment value, the second adjustment value being for adjusting the dot printing positions at a unit of length shorter than a unit of length at which the printing positions are adjusted using the first adjustment value in the predetermined print operation; and a control unit configured to control the print head and the movement unit to make the print head and the movement unit print a print image on a print medium by the predetermined print operation while applying the first adjustment value and the second adjustment value in the control, wherein the control unit determines whether density information of the first pattern measured by the measurement unit is higher than or equal to a threshold, and wherein the control unit controls the print head based on the measurement result of the first pattern measured by the measurement unit such that (a) in a case where the density information is lower than the threshold, the second pattern is printed in a density that is higher than a set density, and (b) in a case where the density information is higher than or equal to the threshold, the second pattern is printed in the set density.

* * * * *